US007867957B2

(12) United States Patent
Matsui et al.

(10) Patent No.: US 7,867,957 B2
(45) Date of Patent: Jan. 11, 2011

(54) LUBRICATING OIL COMPOSITION

(75) Inventors: Shigeki Matsui, Yokohama (JP); Kazuo Tagawa, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 306 days.

(21) Appl. No.: 12/078,308

(22) Filed: Mar. 28, 2008

(65) Prior Publication Data

US 2008/0248981 A1 Oct. 9, 2008

(30) Foreign Application Priority Data

Mar. 30, 2007 (JP) ..... P2007-094823
Mar. 25, 2008 (JP) ..... P2008-078233

(51) Int. Cl.
*C10L 1/22* (2006.01)
*C10M 135/18* (2006.01)
*C10M 137/10* (2006.01)

(52) U.S. Cl. ..... 508/192; 508/363; 508/368; 508/369

(58) Field of Classification Search ..... 508/192, 508/363, 368
See application file for complete search history.

(56) References Cited

U.S. PATENT DOCUMENTS 6,004,910 A * 12/1999 Bloch et al. ..... 508/294
6,703,353 B1 * 3/2004 Lok et al. ..... 508/110

FOREIGN PATENT DOCUMENTS

| | | |
|---|---|---|
| JP | 1-48319 | 10/1989 |
| JP | 3-23595 | 3/1991 |
| JP | 4-36391 | 2/1992 |
| JP | 4-68082 | 3/1992 |
| JP | 5-83599 | 11/1993 |
| JP | 6-62983 | 8/1994 |
| JP | 2000-256690 | 9/2000 |
| JP | 2001-279287 | 10/2001 |
| JP | 2002-503754 | 2/2002 |
| JP | 2004-10799 | 1/2004 |
| JP | 2005-154760 | 6/2005 |
| JP | 2006-502298 | 1/2006 |

* cited by examiner

*Primary Examiner*—Walter D Griffin
*Assistant Examiner*—Frank C Campanell
(74) *Attorney, Agent, or Firm*—Finnegan, Henderson, Farabow, Garrett & Dunner, LLP.

(57) ABSTRACT

The lubricating oil composition of the invention comprises a lubricating base oil with a urea adduct value of no greater than 4% by mass and a viscosity index of 100 or higher, an ashless friction modifier at 0.01-10% by mass and a phosphorus-containing anti-wear agent at 0.01-0.2% by mass as phosphorus, based on the total amount of the composition.

6 Claims, No Drawings

LUBRICATING OIL COMPOSITION

BACKGROUND OF THE INVENTION

1. Field of the Invention

The present invention relates to a lubricating oil composition.

2. Related Background Art

In the field of lubricating oils, additives such as pour point depressants have conventionally been added to lubricating base oils such as highly refined mineral oils to improve the low temperature viscosity properties of the lubricating oils (for example, see Japanese Unexamined Patent Publication HEI No. 4-36391, Japanese Unexamined Patent Publication HEI No. 4-68082, Japanese Unexamined Patent Publication HEI No. 4-120193). Known methods for production of high viscosity index base oils include methods of purifying lubricating base oils by hydrotreatment/hydroisomerization, for stock oils containing natural or synthetic normal paraffins (for example, see Japanese Unexamined Patent Publication No. 2005-154760, Japanese Patent Public Inspection No. 2006-502298 and Japanese Patent Public Inspection No. 2002-503754).

The properties examined when evaluating the low temperature viscosity properties of lubricating base oils and lubricating oils are generally the pour point, cloud point and freezing point. Methods are also known for evaluating the low temperature viscosity property based on the normal paraffin or isoparaffin content of the lubricating base oil.

Lubricating oils are commonly used to ensure smooth operation of machines with sliding section parts, including gears or driven devices such as internal combustion engines, automatic transmissions, dampers, power steering and the like. In particular, lubricating oils for internal combustion engines provide functions of lubrication for parts such as piston rings and cylinder liners, crankshafts, connecting rod bearings, valve gear mechanisms and the like, as well as internal engine cooling, cleaning and dispersion of products and prevention of rust or corrosion.

Such internal combustion engine lubricating oils must not only exhibit a satisfactory low temperature viscosity property but also performance in many other areas, and in recent years it has been a goal to achieve a better trade-off between increased fuel efficiency and improvements in low ash, low phosphorus, low sulfide and long drain performance for exhaust gas after-treatment devices. Because of the large energy loss at areas of friction where lubricating oils function in internal combustion engines, the lubricating oils are combined with various additives including friction reducers, as indicated in Japanese Examined Patent Publication HEI No. 3-23595, for example, to reduce frictional loss and prevent reduced fuel efficiency.

Conventional strategies for reducing the frictional coefficients of lubricating oils have included adding organic molybdenum compounds such as molybdenum dithiocarbamate or molybdenum dithiophosphate, adding combinations of such organic molybdenum compounds with metallic detergents (for example, see Japanese Examined Patent Publication HEI No. 6-62983) or adding combinations of such organic molybdenum compounds with sulfur-based compounds (for example, see Japanese Examined Patent Publication HEI No. 5-83599).

However, significant amounts of soot produced in pistons contaminate the engine oil in diesel engines and direct injection-type gasoline engines. The soot is surface-active and therefore adsorbs the polar additives in the oil, while also chipping at the coating film formed on the friction surface. It has therefore been impossible to obtain a sufficient friction reducing effect under such severe friction conditions even when using organic molybdenum compounds, considered to exhibit the most superior friction reducing effects, because of damage caused by soot and metal abrasion dust. Little research has been conducted on ameliorating this situation, the proposed solutions being limited to mixing alkali metal borate hydrates to improve the fuel efficiency performance of diesel engines (for example, see Japanese Examined Patent Publication HEI No. 1-48319).

It is also known that lowering the viscosity of lubricating oils is effective as a means of increasing fuel efficiency, and multigrade diesel engine oils obtained by adding viscosity index improvers such as polymethacrylates or ethylene-propylene copolymers to low-viscosity lubricating oils are commonly used. Nevertheless, multigrade diesel engine oils containing only such viscosity index improvers have only slight effects of increasing fuel efficiency, and they have been far from satisfactory. Consequently, it is has been highly desired to develop engine oils that can adequately increase fuel efficiency for diesel engines and direct injection-type gasoline engines.

Incidentally, reduction of NOx and suspended particulate matter (SPM) in diesel engines has become a major issue, and various exhaust gas reduction means are being explored, such as high-pressure injection, exhaust gas recirculation (EGR) systems, oxidation catalysts, diesel particulate filters (DPF) and NOx occlusion-reduction catalysts, for the purpose of reducing exhaust gas from such engines.

It is known, however, that the use of such exhaust gas reduction means, and especially oxidation catalysts, NOx occlusion-reduction catalysts and DPF, shortens the life of the exhaust gas after-treatment device depending on the composition of the engine oil that is used. For example, when using a lubricating oil containing zinc dialkyldithiophosphate (hereinafter, "ZnDTP") which is effective as an anti-wear agent or antioxidant (peroxide decomposer) the zinc in the ZnDTP forms oxides, phosphates or sulfates during the combustion process, accumulating on the catalyst surface or in the filter and impairing the purification performance of the exhaust gas after-treatment device. It is therefore preferable for lubricating oils for engines with such exhaust gas after-treatment devices to contain either no added ZnDTP, or only very small amounts if used. Moreover, since the aforementioned problems tend to occur more easily when metal oxides or sulfuric acid salts accumulate as ash, it is also preferred for the metallic detergent and sulfur contents to be as low as possible.

In addition, large amounts of soot contaminate lubricating oils in diesel engines, and especially EGR-equipped diesel engines, and such soot can lead to increased abrasion in valve gear systems or poor high-temperature detergency of the pistons. The effects of soot contamination and resulting combustion chamber deposits and valve deposits are concerns in direct injection gasoline engines as well. Consequently, special difficulties are associated with simply reducing ZnDTP, metallic detergent and sulfur contents, and new strategies are necessary to deal with the lower detergency and anti-wear properties that result from their reduction.

A diesel engine oil composition with a sulfuric acid ash content limited to no greater than 0.7% by mass has been proposed as a lubricating oil composition for engines equipped with exhaust gas after-treatment devices (see Japanese Unexamined Patent Publication No. 2000-256690). Also, engine oils containing dispersant viscosity index improvers have been proposed to improve detergency against soot contamination and to improve anti-wear properties (see Japanese Unexamined Patent Publication No. 2001-279287, Japanese Unexamined Patent Publication No. 2004-10799). These proposed solutions, however, do not always provide sufficient high-temperature detergency and base value retention when metallic detergents are reduced, while the high-temperature detergency and anti-wear properties in the presence of soot contamination have not been adequately studied in the context of reduced ZnDTP content. A need therefore exists for further research in the areas of maintaining or improving high levels of high-temperature detergency and base value retention while minimizing friction in the presence of significant soot contamination in cases where ZnDTP content has been reduced.

SUMMARY OF THE INVENTION

With demands increasing in recent years for improved low temperature viscosity properties of lubricating oils, and improved combinations of low temperature viscosity property and viscosity-temperature characteristic, it has been difficult to completely satisfy such demands even when using lubricating base oils judged to have satisfactory low temperature performance based on the conventional evaluation standards.

Including additives in lubricating base oils can result in some improvement in the properties, but this method has had its own restrictions. Pour point depressants, in particular, do not exhibit effects proportional to the amounts in which they are added, and can even reduce shear stability when added in increased amounts.

It has also been attempted to optimize the conditions for hydrotreatment/hydroisomerization in refining processes for lubricating base oils that employ hydrotreatment/hydroisomerization as mentioned above, from the viewpoint of increasing the isomerization rate from normal paraffins to isoparaffins and improving the low temperature viscosity property by lowering the viscosity of the lubricating base oil, but because the viscosity-temperature characteristic (especially high-temperature viscosity characteristic) and the low temperature viscosity property are in an inverse relationship, it has been extremely difficult to achieve both of these. For example, increasing the isomerization rate from normal paraffins to isoparaffins improves the low temperature viscosity property but results in an unsatisfactory viscosity-temperature characteristic, including a reduced viscosity index. The fact that the above-mentioned properties such as pour point and freezing point are often unsuitable for evaluating the low temperature viscosity properties of lubricating base oils is another factor that impedes optimization of the hydrotreatment/hydroisomerization conditions.

The present invention has been accomplished in light of the circumstances of the prior art, and its object is to provide a lubricating oil composition that achieves a high level of both viscosity-temperature characteristic and low temperature viscosity property, maintains sufficiently low abrasiveness, i.e. high fuel efficiency, even with deterioration of the lubricating oil by contamination with soot or metal abrasion dust, has excellent durability and oxidation stability including anti-wear properties and detergency, while permitting low ash contents, and allows the performance of exhaust gas after-treatment devices to be adequately maintained for long periods.

In order to solve the problems described above, the invention provides a lubricating oil composition comprising a lubricating base oil with a urea adduct value of no greater than 4% by mass and a viscosity index of 100 or higher, an ashless friction modifier at 0.01-10% by mass and a phosphorus-containing anti-wear agent at 0.01-0.2% by mass as phosphorus, based on the total amount of the composition.

The urea adduct value according to the invention is measured by the following method. A 100 g weighed portion of sample oil (lubricating base oil) is placed in a round bottom flask, 200 mg of urea, 360 ml of toluene and 40 ml of methanol are added and the mixture is stirred at room temperature for 6 hours. This produces white particulate crystals as urea adduct in the reaction mixture. The reaction mixture is filtered with a 1 micron filter to obtain the produced white particulate crystals, and the crystals are washed 6 times with 50 ml of toluene. The recovered white crystals are placed in a flask, 300 ml of purified water and 300 ml of toluene are added and the mixture is stirred at 80° C. for 1 hour. The aqueous phase is separated and removed with a separatory funnel, and the toluene phase is washed 3 times with 300 ml of purified water. After dewatering treatment of the toluene phase by addition of a desiccant (sodium sulfate), the toluene is distilled off. The proportion (mass percentage) of urea adduct obtained in this manner with respect to the sample oil is defined as the urea adduct value.

The viscosity index according to the invention, and the kinematic viscosity at 40° C. or 100° C. mentioned hereunder, are the viscosity index and kinematic viscosity at 40° C. or 100° C. measured according to JIS K 2283-1993.

The lubricating base oil composition of the invention comprises an ashless friction modifier and phosphorus-containing anti-wear agent in the ranges specified above with a lubricating base oil having a urea adduct value and viscosity index satisfying the respective conditions specified above, whereby it is able to exhibit its effect of vastly reducing the viscosity resistance and stirring resistance from a practical temperature range to under low temperature conditions of below 0° C., while being highly effective for reducing energy loss and achieving energy savings especially when the lubricating base oil is applied in an internal combustion engine such as a diesel engine or direct injection gasoline engine containing large amounts of soot contamination.

While efforts are being made to improve the isomerization rate from normal paraffins to isoparaffins in conventional refining processes for lubricating base oils by hydrotreatment and hydroisomerization, as mentioned above, the present inventors have found that it is difficult to satisfactorily improve the low temperature viscosity property simply by reducing the residual amount of normal paraffins. That is, although the isoparaffins produced by hydrotreatment and hydroisomerization also contain components that adversely affect the low temperature viscosity property, this fact has not been fully appreciated in the conventional methods of evaluation. Methods such as gas chromatography (GC) and NMR are also applied for analysis of normal paraffins and isoparaffins, but using these analysis methods for separation and identification of the components in isoparaffins that adversely affect the low temperature viscosity property involves complicated procedures and is time-consuming, making them ineffective for practical use.

Measurement of the urea adduct value according to the invention, on the other hand, allows precise and reliable collection of the components in isoparaffins that can adversely affect the low temperature viscosity property, as well as the normal paraffins when normal paraffins are residually present in the lubricating base oil, as urea adducts, and is therefore an excellent indicator for evaluation of the low temperature viscosity properties of lubricating base oils. The present inventors have confirmed that when analysis is conducted using GC and NMR, the main urea adducts are urea adducts of normal paraffins and of isoparaffins with 6 or more carbon atoms from the main chain to the point of branching.

According to the invention, the lubricating base oil is preferably one produced by a production process that includes a step of hydrotreatment/hydroisomerization of a stock oil containing normal paraffins so as to obtain a treatment product having a urea adduct value of no greater than 4% by mass and a viscosity index of 100 or higher.

More preferably, the kinematic viscosity at 100° C. of the lubricating base oil is at least 3.5 $mm^2/s$ and the CCS viscosity at −35° C. of the lubricating base oil is no greater than 2000 mPa·s.

Also, the NOACK evaporation of the lubricating base oil is preferably no greater than 15% by mass.

The product of the kinematic viscosity at 40° C. (units: $mm^2/s$) and the NOACK evaporation (units: % by mass) of the lubricating base oil is preferably no greater than 250.

The ashless friction modifier is preferably a compound containing at least 3 atoms of any one or more selected from among nitrogen, oxygen and sulfur.

The lubricating oil composition of the invention preferably contains an organic molybdenum compound other than a molybdenum dithiocarbamate or molybdenum dithiophosphate at 0.001-0.2% by mass as molybdenum based on the total amount of the composition.

There are no particular restrictions on uses of the lubricating oil composition of the invention, but a notable effect is exhibited when it is used as a lubricating oil for a diesel engine or direct injection gasoline engine.

As mentioned above, the invention provides a lubricating oil composition that exhibits a high level of both viscosity-temperature characteristic and low temperature viscosity property, maintains sufficiently low abrasiveness, i.e. high fuel efficiency, even with deterioration of the lubricating oil by contamination with soot or metal abrasion dust, has excellent durability and oxidation stability including anti-wear properties and detergency, while permitting low ash contents, and allows the performance of exhaust gas after-treatment devices to be adequately maintained for long periods.

DESCRIPTION OF THE PREFERRED EMBODIMENTS

Preferred embodiments of the invention will now be described in detail.

The lubricating oil composition of the invention comprises a lubricating base oil with a urea adduct value of 4% by mass and a viscosity index of 100 or greater (hereinafter referred to as "lubricating base oil of the invention").

From the viewpoint of improving the low temperature viscosity property without impairing the viscosity-temperature characteristic, the urea adduct value of the lubricating base oil of the invention must be no greater than 4% by mass as mentioned above, but it is preferably no greater than 3.5% by mass, more preferably no greater than 3% by mass and even more preferably no greater than 2.5% by mass. The urea adduct value of the lubricating base oil may even be 0% by mass.

From the viewpoint of improving the viscosity-temperature characteristic, the viscosity index of the lubricating base oil of the invention must be 100 or higher as mentioned above, but it is preferably 110 or greater, more preferably 120 or greater, even more preferably 130 or greater and most preferably 140 or greater.

The stock oil used for production of the lubricating base oil of the invention may include normal paraffins or normal paraffin-containing wax. The stock oil may be a mineral oil or a synthetic oil, or a mixture of two or more thereof. The normal paraffin content of the stock oil is preferably 50% by mass or greater, more preferably 70% by mass or greater, even more preferably 80% by mass or greater, yet more preferably 90% by mass, even yet more preferably 95% by mass or greater and most preferably 97% by mass or greater, based on the total amount of the stock oil.

The stock oil used for the invention preferably is a wax-containing starting material that boils in the range of lubricating oils according to ASTM D86 or ASTM D2887. The wax content of the stock oil is preferably between 50% by mass and 100% by mass based on the total amount of the stock oil. The wax content of the starting material can be measured by methods of analysis such as nuclear magnetic resonance spectroscopy (ASTM D5292), correlative ring analysis (n-d-M) (ASTM D3238) or the solvent method (ASTM D3235).

As examples of wax-containing starting materials there may be mentioned oils derived from solvent refining methods, such as raffinates, partial solvent dewaxed oils, deasphalted oils, distillates, vacuum gas oils, coker gas oils, slack waxes, foot oil, Fischer-Tropsch waxes and the like, among which slack waxes and Fischer-Tropsch waxes are preferred.

Slack wax is typically derived from hydrocarbon starting materials by solvent or propane dewaxing. Slack waxes may contain residual oil, but the residual oil can be removed by deoiling. Foot oil corresponds to deoiled slack wax.

Fischer-Tropsch waxes are produced by so-called Fischer-Tropsch synthesis.

Commercial normal paraffin-containing stock oils are also available. Specifically, there may be mentioned Paraflint 80 (hydrogenated Fischer-Tropsch wax) and Shell MDS Waxy Raffinate (hydrogenated and partially isomerized heart cut distilled synthetic wax raffinate).

Stock oil from solvent extraction is obtained by feeding a high boiling point petroleum fraction from atmospheric distillation to a vacuum distillation apparatus and subjecting the distillation fraction to solvent extraction. The residue from vacuum distillation may also be deasphalted. In solvent extraction methods, the aromatic components are dissolved in the extract phase while leaving the more paraffinic components in the raffinate phase. Naphthenes are distributed in the extract phase and raffinate phase. The preferred solvents for solvent extraction are phenols, furfurals and N-methylpyrrolidone. By controlling the solvent/oil ratio, extraction temperature and method of contacting the solvent with the distillate to be extracted, it is possible to control the degree of separation between the extract phase and raffinate phase. There may also be used as the starting material a bottom fraction obtained from a fuel oil hydrotreatment apparatus, using a fuel oil hydrotreatment apparatus with higher hydrotreatment performance.

The lubricating base oil of the invention may be obtained through a step of hydrotreatment/hydroisomerization of the stock oil so as to obtain a treatment product having a urea adduct value of no greater than 4% by mass and a viscosity index of 100 or higher. The hydrotreatment/hydroisomerization step is not particularly restricted so long as it satisfies the aforementioned conditions for the urea adduct value and viscosity index of the treatment product. A preferred hydrotreatment/hydroisomerization step according to the invention comprises:

a first step in which a normal paraffin-containing stock oil is subjected to hydrotreatment using a hydrotreatment catalyst, a second step in which the treatment product from the first step is subjected to hydrogenation using a hydrodewaxing catalyst, and a third step in which the treatment product from the second step is subjected to hydrorefining using a hydrorefining catalyst.

Conventional hydrotreatment/hydroisomerization also includes a hydrotreatment step in an early stage of the hydrodewaxing step, for the purpose of desulfurization and denitrogenation to prevent poisoning of the hydrodewaxing catalyst. In contrast, the first step (hydrotreatment step) according to the invention is carried out to decompose a portion (for example, about 10% by mass and preferably 1-10% by mass) of the normal paraffins in the stock oil at an early stage of the second step (hydrodewaxing step), thus allowing desulfurization and denitrification in the first step as well, although the purpose differs from that of conventional hydrotreatment. The first step is preferred in order to reliably limit the urea adduct of the treatment product obtained after the third step (the lubricating base oil) to no greater than 4% by mass.

As hydrogenation catalysts to be used in the first step there may be mentioned catalysts containing Group 6 metals and Group 8-10 metals, as well as mixtures thereof. As preferred metals there may be mentioned nickel, tungsten, molybdenum and cobalt, and mixtures thereof. The hydrogenation catalyst may be used in a form with the aforementioned metals supported on a heat resistant metal oxide support, and normally the metal will be present on the support as an oxide or sulfide. When a mixture of metals is used, it may be used as a bulk metal catalyst with an amount of metal of at least 30% by mass based on the total amount of the catalyst. The metal oxide support may be an oxide such as silica, alumina, silica-alumina or titania, with alumina being preferred. Preferred alumina is γ or β porous alumina. The loading amount of the metal is preferably 0.5-35% by mass based on the total amount of the catalyst. When a mixture of a metal of Group 9-10 and a metal of Group 6 is used, preferably the metal of Group 9 or 10 is present in an amount of 0.1-5% by mass and the metal of Group 6 is present in an amount of 5-30% by mass based on the total amount of the catalyst. The loading amount of the metal may be measured by atomic absorption spectrophotometry or inductively coupled plasma emission spectroscopy, or the individual metals may be measured by other ASTM methods.

The acidity of the metal oxide support can be controlled by controlling the addition of additives and the nature of the metal oxide support (for example, controlling the amount of silica incorporated in a silica-alumina support). As examples of additives there may be mentioned halogens, especially fluorine, and phosphorus, boron, yttria, alkali metals, alkaline earth metals, rare earth oxides and magnesia. Co-catalysts such as halogens generally raise the acidity of metal oxide supports, but weakly basic additives such as yttria and magnesia can be used to lower the acidity of the support.

Among the hydrotreatment conditions, the treatment temperature is preferably 150-450° C. and more preferably 200-400° C., the hydrogen partial pressure is preferably 1400-20,000 kPa and more preferably 2800-14,000 kPa, the liquid space velocity (LHSV) is preferably 0.1-10 hr 1 and more preferably 0.1-5 $hr^{-1}$, and the hydrogen/oil ratio is preferably 50-1780 $m^3/m^3$ and more preferably 89-890 $m^3/m^3$. These conditions are only for example, and the hydrotreatment conditions in the first step may be appropriately selected for different starting materials, catalysts and apparatuses, in order to obtain the specified urea adduct value and viscosity index for the treatment product obtained after the third step.

The treatment product obtained by hydrotreatment in the first step may be directly supplied to the second step, but a step of stripping or distillation of the treatment product and separating removal of the gas product from the treatment product (liquid product) is preferably conducted between the first step and second step. This can reduce the nitrogen and sulfur contents in the treatment product to levels that will not affect prolonged use of the hydrodewaxing catalyst in the second step. The main objects of separating removal by stripping and the like are the gaseous contaminants such as hydrogen sulfide and ammonia, and for this purpose stripping can be accomplished by ordinary means such as a flash drum, distiller or the like.

When the hydrotreatment conditions in the first step are mild, polycyclic aromatic components can potentially remain as residue, depending on the starting material used, and such contaminants may be removed by hydrorefining in the third step.

The hydrodewaxing catalyst used in the second step may contain crystalline or amorphous materials. As examples of crystalline materials there may be mentioned molecular sieves having 10- or 12-membered ring channels, composed mainly of aluminosilicates (zeolite) or silicoaluminophosphates (SAPO). As specific examples of zeolites there may be mentioned ZSM-22, ZSM-23, ZSM-35, ZSM-48, ZSM-57, ferrierite, ITQ-13, MCM-68, MCM-71 and the like. ECR-42 may be mentioned as an example of an aluminophosphate. As examples of molecular sieves there may be mentioned zeolite beta and MCM-68. Among the above there are preferably used one or more selected from among ZSM-48, ZSM-22 and ZSM-23, with ZSM-48 being particularly preferred. The molecular sieves are preferably hydrogen-type. Reduction of the hydrodewaxing catalyst may occur at the time of hydrodewaxing, but alternatively a hydrodewaxing catalyst that has been previously subjected to reduction treatment may be used for the hydrodewaxing.

As amorphous materials for the hydrodewaxing catalyst there may be mentioned alumina doped with Group 3 metals, fluorinated alumina, silica-alumina, fluorinated silica-alumina, and the like.

A preferred mode of the dewaxing catalyst is a bifunctional catalyst, i.e. one carrying a metal hydrogenated component which is at least one metal of Group 6, at least one metal of Groups 8-10 or a mixture thereof. Preferred metals are precious metals of Groups 9-10, such as Pt, Pd or mixtures thereof. Such metals are carried at preferably 0.1-30% by mass based on the total amount of the catalyst. The method for preparation of the catalyst and loading of the metal may be, for example, an ion exchange method or impregnation method using a decomposable metal salt.

When molecular sieves are used, they may be compounded with a binder material that is heat resistant under the hydrodewaxing conditions, or they may be binderless (self-binding). As binder materials there may be mentioned inorganic oxides, including silica, alumina, silica-alumina, two-component combinations of silica with other metal oxides such as titania, magnesia, yttria and zirconia, and three-containing combinations of oxides such as silica-alumina-yttria, silica-alumina-magnesia and the like. The amount of molecular sieves in the hydrodewaxing catalyst is preferably 10-100% by mass and more preferably 35-100% by mass based on the total amount of the catalyst. The hydrodewaxing catalyst may be formed by a method such as spray-drying or extrusion. The hydrodewaxing catalyst may be used in sulfided or non-sulfided form, although a sulfided form is preferred.

As regards the hydrodewaxing conditions, the temperature is preferably 250-400° C. and more preferably 275-350° C., the hydrogen partial pressure is preferably 791-20,786 kPa (100-3000 psig) and more preferably 1480-17,339 kPa (200-2500 psig), the liquid space velocity is preferably 0.1-10 $hr^{-1}$ and more preferably 0.1-5 $hr^{-1}$, and the hydrogen/oil ratio is preferably 45-1780 $m^3/m^3$ (250-10,000 scf/B) and more preferably 89-890 $m^3/m^3$ (500-5000 scf/B). These conditions are only for example, and the hydrodewaxing conditions in the second step may be appropriately selected for different starting materials, catalysts and apparatuses, in order to obtain the specified urea adduct value and viscosity index for the treatment product obtained after the third step.

The treatment product that has been hydrodewaxed in the second step is then supplied to hydrorefining in the third step. Hydrorefining is a form of mild hydrotreatment aimed at removing residual heteroatoms and color components while also saturating the olefins and residual aromatic compounds by hydrogenation. The hydrorefining in the third step may be carried out in a cascade fashion with the dewaxing step.

The hydrorefining catalyst used in the third step is preferably one comprising a Group 6 metal, a Group 8-10 metal or a mixture thereof supported on a metal oxide support. As preferred metals there may be mentioned precious metals, and especially platinum, palladium and mixtures thereof. When a mixture of metals is used, it may be used as a bulk metal catalyst with an amount of metal of 30% by mass or greater based on the amount of the catalyst. The metal content of the catalyst is preferably no greater than 20% by mass of non-precious metals and preferably no greater than 1% by mass of precious metals. The metal oxide support may be either an amorphous or crystalline oxide. Specifically, there may be mentioned low acidic oxides such as silica, alumina, silica-alumina and titania, with alumina being preferred. From the viewpoint of saturation of aromatic compounds, it is preferred to use a hydrorefining catalyst comprising a metal with a relatively powerful hydrogenating function supported on a porous carrier.

As preferred hydrorefining catalysts there may be mentioned meso-microporous materials belonging to the M41S class or line of catalysts. M41S line catalysts are meso-microporous materials with high silica contents, and specifically there may be mentioned MCM-41, MCM-48 and MCM-50. The hydrorefining catalyst has a pore size of 15-100 Å, and MCM-41 is particularly preferred. MCM-41 is an inorganic porous non-laminar phase with a hexagonal configuration and pores of uniform size. The physical structure of MCM-41 manifests as straw-like bundles with straw openings (pore cell diameters) in the range of 15-100 angstroms. MCM-48 has cubic symmetry, while MCM-50 has a laminar structure. MCM-41 may also have a structure with pore openings having different meso-microporous ranges. The meso-microporous material may contain metal hydrogenated components consisting of one or more Group 8, 9 or 10 metals, and preferred as metal hydrogenated components are precious metals, especially Group 10 precious metals, and most preferably Pt, Pd or their mixtures.

As regards the hydrorefining conditions, the temperature is preferably 150-350° C. and more preferably 180-250° C., the total pressure is preferably 2859-20,786 kPa (about 400-3000 psig), the liquid space velocity is preferably 0.1-5 $hr^{-1}$ and more preferably 0.5-3 $hr^{-1}$ and the hydrogen/oil ratio is preferably 44.5-1780 $m^3/m^3$ (250-10,000 scf/B). These conditions are only for example, and the hydrorefining conditions in the third step may be appropriately selected for different starting materials and treatment apparatuses, in order to obtain the specified urea adduct value and viscosity index for the treatment product obtained after the third step.

The treatment product obtained after the third step may be subjected to distillation or the like as necessary for separating removal of certain components.

The lubricating base oil of the invention obtained by the production process described above is not restricted in terms of its other properties so long as the urea adduct value and viscosity index satisfy their respective conditions, but the lubricating base oil of the invention preferably also satisfies the conditions specified below.

The saturate component content of the lubricating base oil of the invention is preferably 90% by mass or greater, more preferably 93% by mass or greater and even more preferably 95% by mass or greater based on the total amount of the lubricating base oil. The proportion of cyclic saturate components among the saturate components is preferably 0.1-50% by mass, more preferably 0.5-40% by mass, even more preferably 1-30% by mass and most preferably 5-20% by mass. If the saturate component content and proportion of cyclic saturate components among the saturate components both satisfy these respective conditions, it will be possible to achieve adequate levels for the viscosity-temperature characteristic and heat and oxidation stability, while additives added to the lubricating base oil will be kept in a sufficiently stable dissolved state in the lubricating base oil so that the functions of the additives can be exhibited at a higher level. In addition, a saturate component content and proportion of cyclic saturate components among the saturate components satisfying the aforementioned conditions can improve the frictional properties of the lubricating base oil itself, resulting in a greater friction reducing effect and thus increased energy savings.

If the saturate component content is less than 90% by mass, the viscosity-temperature characteristic, heat and oxidation stability and frictional properties will tend to be inadequate. If the proportion of cyclic saturate components among the saturate components is less than 0.1% by mass, the solubility of the additives included in the lubricating base oil will be insufficient and the effective amount of additives kept dissolved in the lubricating base oil will be reduced, making it impossible to effectively achieve the functions of the additives. If the proportion of cyclic saturate components among the saturate components is greater than 50% by mass, the efficacy of additives included in the lubricating base oil will tend to be reduced.

According to the invention, a proportion of 0.1-50% by mass cyclic saturate components among the saturate components is equivalent to 99.9-50% by mass acyclic saturate components among the saturate components. Both normal paraffins and isoparaffins are included by the term "acyclic saturate components". The proportions of normal paraffins and isoparaffins in the lubricating base oil of the invention are not particularly restricted so long as the urea adduct value satisfies the condition specified above, but the proportion of isoparaffins is preferably 50-99.9% by mass, more preferably 60-99.9% by mass, even more preferably 70-99% by mass and most preferably 80-99.9% by mass based on the total amount of the lubricating base oil. If the proportion of isoparaffins among the saturate components satisfies the aforementioned conditions it will be possible to further improve the viscosity-temperature characteristic and heat and oxidation stability, while additives added to the lubricating base oil will be kept in a sufficiently stable dissolved state in the lubricating base oil so that the functions of the additives can be exhibited at an even higher level.

The saturate component content for the purpose of the invention is the value measured according to ASTM D 2007-93 (units: % by mass).

The proportions of the cyclic saturate components and acyclic saturate components among the saturate components for the purpose of the invention are the naphthene portion (measurement of monocyclic-hexacyclic naphthenes, units: % by mass) and alkane portion (units: % by mass), respectively, both measured according to ASTM D 2786-91.

The proportion of normal paraffins in the lubricating base oil for the purpose of the invention is the value obtained by analyzing saturate components separated and fractionated by the method of ASTM D 2007-93 by gas chromatography under the following conditions, and calculating the value obtained by identifying and quantifying the proportion of normal paraffins among those saturate components, with respect to the total amount of the lubricating base oil. A C5-50 normal paraffin mixed sample is used as the reference sample for identification and quantitation, and the normal paraffins in the saturate components are determined as a proportion of the total peak area values corresponding to each normal paraffin, with respect to the total peak area value in the chromatogram (ignoring the area of peaks for the diluent).

(Gas Chromatography Conditions)

Column: Liquid phase nonpolar column (length: 25 mm, inner diameter: 0.3 mmϕ, liquid phase film thickness: 0.1 μm).

Temperature elevating conditions: 50° C.-400° C. (temperature-elevating rate: 10° C./min).

Carrier gas: helium (linear speed: 40 cm/min)

Split ratio: 90/1

Sample injection rate: 0.5 μL (injection rate of sample diluted 20-fold with carbon disulfide).

The proportion of isoparaffins in the lubricating base oil is the value of the difference between the acyclic saturate components among the saturate components and the normal paraffins among the saturate components, based on the total amount of the lubricating base oil.

Other methods may be used for separation of the saturate components or for compositional analysis of the cyclic saturate components and acyclic saturate components, so long as they provide similar results. As examples of other methods there may be mentioned the method according to ASTM D 2425-93, the method according to ASTM D 2549-91, methods of high performance liquid chromatography (HPLC), and modified forms of these methods.

When the bottom fraction obtained from a fuel oil hydrotreatment apparatus is used as the starting material for the lubricating base oil of the invention, the obtained base oil will have a saturate component content of 90% by mass or greater, a proportion of cyclic saturate components in the saturate components of 30-50% by mass, a proportion of acyclic saturate components in the saturate components of 50-70% by mass, a proportion of isoparaffins in the lubricating base oil of 40-70% by mass and a viscosity index of 100-135 and preferably 120-130, but if the urea adduct value satisfies the conditions specified above it will be possible to drastically improve the effect of the invention, and especially the low temperature viscosity property. When a slack wax or Fischer-Tropsch wax having a high wax content (for example, a normal paraffin content of 50% by mass or greater) is used as the starting material for the lubricating base oil of the invention, the obtained base oil will have a saturate component content of 90% by mass or greater, a proportion of cyclic saturate components in the saturate components of 0.1-40% by mass, a proportion of acyclic saturate components in the saturate components of 60-99.9% by mass, a proportion of isoparaffins in the lubricating base oil of 60-99.9% by mass and a viscosity index of 100-170 and preferably 135-160, but if the urea adduct value satisfies the conditions specified above it will be possible to obtain a lubricating oil composition with very excellent properties in terms of the effect of the invention, and especially the high viscosity index and low temperature viscosity property.

If the 20° C. refractive index is represented as $n_{20}$ and the kinematic viscosity at 100° C. is represented as kv100, the value of $n_{20}$-0.002×kv100 for the lubricating base oil of the invention is preferably 1.435-1.450, more preferably 1.440-1.449, even more preferably 1.442-1.448 and yet more preferably 1.444-1.447. If $n_{20}$−0.002×kv100 is within the range specified above it will be possible to achieve an excellent viscosity-temperature characteristic and high heat and oxidation stability, while additives added to the lubricating base oil will be kept in a sufficiently stable dissolved state in the lubricating base oil so that the functions of the additives can be exhibited at an even higher level. A $n_{20}$−0.002×kv100 value within the aforementioned range can also improve the frictional properties of the lubricating base oil itself, resulting in a greater friction reducing effect and thus increased energy savings.

If the $n_{20}$−0.002×kv100 value exceeds the aforementioned upper limit, the viscosity-temperature characteristic, heat and oxidation stability and frictional properties will tend to be insufficient, and the efficacy of additives when added to the lubricating base oil will tend to be reduced. If the $n_{20}$−0.002×kv100 value is less than the aforementioned lower limit, the solubility of the additives included in the lubricating base oil will be insufficient and the effective amount of additives kept dissolved in the lubricating base oil will be reduced, making it impossible to effectively achieve the functions of the additives.

The 20° C. refractive index ($n_{20}$) for the purpose of the invention is the refractive index measured at 20° C. according to ASTM D1218-92. The kinematic viscosity at 100° C. (kv100) for the purpose of the invention is the kinematic viscosity measured at 100° C. according to JIS K 2283-1993.

The aromatic content of the lubricating base oil of the invention is preferably no greater than 5% by mass, more preferably 0.05-3% by mass, even more preferably 0.1-1% by mass and most preferably 0.1-0.5% by mass based on the total amount of the lubricating base oil. If the aromatic content exceeds the aforementioned upper limit, the viscosity-temperature characteristic, heat and oxidation stability, frictional properties, resistance to volatilization and low temperature viscosity property will tend to be reduced, while the efficacy of additives when added to the lubricating base oil will also tend to be reduced. The lubricating base oil of the invention may be free of aromatic components, but the solubility of additives can be further increased with an aromatic content of 0.05% by mass or greater.

The aromatic content in this case is the value measured according to ASTM D 2007-93. The aromatic portion normally includes alkylbenzenes and alkylnaphthalenes, as well as anthracene, phenanthrene and their alkylated forms, compounds with four or more fused benzene rings, and heteroatom-containing aromatic compounds such as pyridines, quinolines, phenols, naphthols and the like.

The % $C_p$ value of the lubricating base oil of the invention is preferably 80 or greater, more preferably 82-99, even more preferably 85-98 and most preferably 90-97. If the % $C_p$ value of the lubricating base oil is less than 80, the viscosity-temperature characteristic, heat and oxidation stability and frictional properties will tend to be reduced, while the efficacy of additives when added to the lubricating base oil will also tend to be reduced. If the % $C_p$ value of the lubricating base oil is greater than 99, on the other hand, the additive solubility will tend to be lower.

The % $C_N$ value of the lubricating base oil of the invention is preferably no greater than 20, more preferably no greater than 15, even more preferably 1-12 and most preferably 3-10. If the % $C_N$ value of the lubricating base oil exceeds 20, the viscosity-temperature characteristic, heat and oxidation stability and frictional properties will tend to be reduced. If the % $C_N$ is less than 1, however, the additive solubility will tend to be lower.

The % $C_A$ value of the lubricating base oil of the invention is preferably no greater than 0.7, more preferably no greater than 0.6 and even more preferably 0.1-0.5. If the % $C_A$ value of the lubricating base oil exceeds 0.7, the viscosity-temperature characteristic, heat and oxidation stability and frictional properties will tend to be reduced. The % $C_A$ value of the lubricating base oil of the invention may be zero, but the solubility of additives can be further increased with a % $C_A$ value of 0.1 or greater.

The ratio of the % $C_P$ and % $C_N$ values for the lubricating base oil of the invention is % $C_P$/% $C_N$ of preferably 7 or greater, more preferably 7.5 or greater and even more preferably 8 or greater. If the % $C_P$/% $C_N$ ratio is less than 7, the viscosity-temperature characteristic, heat and oxidation stability and frictional properties will tend to be reduced, while the efficacy of additives when added to the lubricating base oil will also tend to be reduced. The % $C_P$/% $C_N$ ratio is preferably no greater than 200, more preferably no greater than 100, even more preferably no greater than 50 and most preferably no greater than 25. The additive solubility can be further increased if the % $C_P$/% $C_N$ ratio is no greater than 200.

The % $C_P$, % $C_N$ and % $C_A$ values for the purpose of the invention are, respectively, the percentage of paraffinic carbons with respect to total carbon atoms, the percentage of naphthenic carbons with respect to total carbons and the percentage of aromatic carbons with respect to total carbons, as determined by the methods of ASTM D 3238-85 (n-d-M ring analysis). That is, the preferred ranges for % $C_P$, % $C_N$ and % $C_A$ are based on the values determined by these methods, and for example, % $C_N$ may be a value exceeding zero according to these methods even if the lubricating base oil contains no naphthene portion.

The iodine value of the lubricating base oil of the invention is preferably no greater than 0.5, more preferably no greater than 0.3 and even more preferably no greater than 0.15, and although it may be less than 0.01, it is preferably 0.001 or greater and more preferably 0.05 or greater in consideration of economy and achieving a significant effect. Limiting the iodine value of the lubricating base oil to no greater than 0.5 can drastically improve the heat and oxidation stability. The iodine value for the purpose of the invention is the iodine value measured by the indicator titration method according to JIS K 0070, "Acid Values, Saponification Values, Iodine Values, Hydroxyl Values and Unsaponification Values Of Chemical Products".

The sulfur content in the lubricating base oil of the invention will depend on the sulfur content of the starting material. For example, when using a substantially sulfur-free starting material such as a synthetic wax component obtained by Fischer-Tropsch reaction, it is possible to obtain a substantially sulfur-free lubricating base oil. When using a sulfur-containing starting material, such as slack wax obtained by a lubricating base oil refining process or microcrystalline wax obtained by a wax refining process, the sulfur content of the obtained lubricating base oil will normally be 100 ppm by mass or greater. The lubricating base oil of the invention preferably has a sulfur content of no greater than 10 ppm by mass, more preferably no greater than 5 ppm by mass and even more preferably no greater than 3 ppm by mass, from the viewpoint of further improving the heat and oxidation stability and achieving low sulfurization.

From the viewpoint of cost reduction it is preferred to use a slack wax or the like as the starting material, in which case the sulfur content of the obtained lubricating base oil is preferably no greater than 50 ppm by mass and more preferably no greater than 10 ppm by mass. The sulfur content for the purpose of the invention is the sulfur content measured according to JIS K 2541-1996.

The nitrogen content in the lubricating base oil of the invention is not particularly restricted, but is preferably no greater than 5 ppm by mass, more preferably no greater than 3 ppm by mass and even more preferably no greater than 1 ppm by mass. If the nitrogen content exceeds 5 ppm by mass, the heat and oxidation stability will tend to be reduced. The nitrogen content for the purpose of the invention is the nitrogen content measured according to JIS K 2609-1990

The kinematic viscosity of the lubricating base oil according to the invention, as the kinematic viscosity at 100° C., is preferably 1.5-20 $mm^2/s$ and more preferably 2.0-11 $mm^2/s$. A kinematic viscosity at 100° C. of lower than 1.5 $mm^2/s$ for the lubricating base oil is not preferred from the standpoint of evaporation loss. If it is attempted to obtain a lubricating base oil having a kinematic viscosity at 100° C. of greater than 20 $mm^2/s$, the yield will be reduced and it will be difficult to increase the cracking severity even when using a heavy wax as the starting material.

According to the invention, a lubricating base oil having a kinematic viscosity at 100° C. in one of the following ranges is preferably used after fractionation by distillation or the like.

(I) A lubricating base oil having a kinematic viscosity at 100° C. of at least 1.5 $mm^2/s$ and lower than 3.5 $mm^2/s$ and more preferably 2.0-3.0 $mm^2/s$.

(II) A lubricating base oil having a kinematic viscosity at 100° C. of at least 3.0 $mm^2/s$ and lower than 4.5 $mm^2/s$ and more preferably 3.5-4.1 $mm^2/s$.

(III) A lubricating base oil having a kinematic viscosity at 100° C. of 4.5-20 $mm^2/s$, more preferably 4.8-11 $mm^2/s$ and most preferably 5.5-8.0 $mm^2/s$.

The kinematic viscosity at 40° C. of the lubricating base oil of the invention is preferably 6.0-80 $mm^2/s$ and more preferably 8.0-50 $mm^2/s$. According to the invention, a lube-oil distillate having a kinematic viscosity at 40° C. in one of the following ranges is preferably used after fractionation by distillation or the like.

(IV) A lubricating base oil having a kinematic viscosity at 40° C. of at least 6.0 $mm^2/s$ and lower than 12 $mm^2/s$ and more preferably 8.0-12 $mm^2/s$.

(V) A lubricating base oil having a kinematic viscosity at 40° C. of at least 12 $mm^2/s$ and lower than 28 $mm^2/s$ and more preferably 13-19 $mm^2/s$.

(VI) A lubricating base oil having a kinematic viscosity at 40° C. of 28-50 $mm^2/s$, more preferably 29-45 $mm^2/s$ and most preferably 30-40 $mm^2/s$.

The lubricating base oils (I) and (IV) having urea adduct values and viscosity indexes satisfying the respective conditions specified above can achieve higher levels of both the viscosity-temperature characteristic and low temperature viscosity property compared to conventional lubricating base oils of the same viscosity grade, and in particular they have excellent low temperature viscosity properties whereby the viscosity resistance or stirring resistance can notably reduced. Moreover, by including a pour point depressant it is possible to lower the −40° C. BF viscosity to below 2000 mPa·s. The −40° C. BF viscosity is the viscosity measured according to JPI-5S-26-99.

The lubricating base oils (II) and (V) having urea adduct values and viscosity indexes satisfying the respective conditions specified above can achieve higher levels of both the viscosity-temperature characteristic and low temperature viscosity property compared to conventional lubricating base oils of the same viscosity grade, and in particular they have excellent low temperature viscosity properties, and superior lubricity and resistance to volatilization. For example, with lubricating base oils (II) and (V) it is possible to lower the CCS viscosity at −35° C. to below 3000 mPa·s.

The lubricating base oils (III) and (VI) having urea adduct values and viscosity indexes satisfying the respective conditions specified above can achieve higher levels of both the viscosity-temperature characteristic and low temperature viscosity property compared to conventional lubricating base oils of the same viscosity grade, and in particular they have excellent low temperature viscosity properties, and superior heat and oxidation stability, lubricity and resistance to volatilization.

The 20° C. refractive index of the lubricating base oil of the invention will depend on the viscosity grade of the lubricating base oil, but the 20° C. refractive indexes of the lubricating base oils (I) and (IV) mentioned above are preferably no greater than 1.455, more preferably no greater than 1.453 and even more preferably no greater than 1.451. The 20° C. refractive indexes of the lubricating base oils (II) and (V) are preferably no greater than 1.460, more preferably no greater than 1.457 and even more preferably no greater than 1.455. The 20° C. refractive indexes of the lubricating base oils (III) and (VI) are preferably no greater than 1.465, more preferably no greater than 1.463 and even more preferably no greater than 1.460. If the refractive index exceeds the aforementioned upper limit, the viscosity-temperature characteristic, heat and oxidation stability, resistance to volatilization and low temperature viscosity property of the lubricating base oil will tend to be reduced, while the efficacy of additives when added to the lubricating base oil will also tend to be reduced.

The pour point of the lubricating base oil of the invention will depend on the viscosity grade of the lubricating base oil, but the pour points of the lubricating base oils (I) and (IV) are preferably no higher than −10° C., more preferably no higher than −12.5° C. and even more preferably no higher than −15° C. The pour points of the lubricating base oils (II) and (V) are preferably no higher than −10° C., more preferably no higher than −15° C. and even more preferably no higher than −17.5° C. The pour points of the lubricating base oils (III) and (VI) are preferably no higher than −10° C., more preferably no higher than −12.5° C. and even more preferably no higher than −15° C. If the pour point exceeds the upper limit specified above, the low-temperature flow properties of a lubricating oil employing the lubricating base oil will tend to be reduced. The pour point for the purpose of the invention is the pour point measured according to JIS K 2269-1987.

The CCS viscosity at −35° C. of the lubricating base oil of the invention will depend on the viscosity grade of the lubricating base oil, but the −35° C. CCS viscosities of the lubricating base oils (I) and (IV) are preferably no greater than 1000 mPa·s. The −35° C. CCS viscosities of the lubricating base oils (II) and (V) are preferably no greater than 3000 mPa·s, more preferably no greater than 2400 mPa·s, even more preferably 2000 no greater than mPa·s, even more preferably no greater than 1800 mPa·s, yet more preferably no greater than 1600 mPa·s and most preferably no greater than 1500 mPa·s. The −35° C. CCS viscosities of the lubricating base oils (III) and (VI) are preferably no greater than 15,000 mPa·s and more preferably no greater than 10,000 mPa·s. If the CCS viscosity at −35° C. exceeds the upper limit specified above, the low-temperature flow properties of a lubricating oil employing the lubricating base oil will tend to be reduced. The CCS viscosity at −35° C. for the purpose of the invention is the viscosity measured according to JIS K 2010-1993.

The −40° C. BF viscosity of the lubricating base oil of the invention will depend on the viscosity grade of the lubricating base oil, but the −40° C. BF viscosities of the lubricating base oils (I) and (IV) are preferably no greater than 10,000 mPa·s, more preferably no greater than 8000 mPa·s and even more preferably no greater than 6000 mPa·s. The −40° C. BF viscosities of the lubricating base oils (II) and (V) are preferably no greater than 1,500,000 mPa·s and more preferably no greater than 1,000,000 mPa·s. If the −40° C. BF viscosity exceeds the upper limit specified above, the low-temperature flow properties of a lubricating oil employing the lubricating base oil will tend to be reduced.

The 15° C. density ($\rho_{15}$) of the lubricating base oil of the invention will also depend on the viscosity grade of the lubricating base oil, but it is preferably no greater than the value of $\rho$ as represented by the following formula (1), i.e., $\rho_{15} \leqq \rho$.

$$\rho = 0.0025 \times kv100 + 0.816 \quad (1)$$

[In this equation, kv100 represents the kinematic viscosity at 100° C. ($mm^2/s$) of the lubricating base oil.]

If $\rho_{15} > \rho$, the viscosity-temperature characteristic, heat and oxidation stability, resistance to volatilization and low temperature viscosity property of the lubricating base oil will tend to be reduced, while the efficacy of additives when added to the lubricating base oil will also tend to be reduced.

The $\rho_{15}$ values of the lubricating base oils (I) and (IV), for example, are preferably no greater than 0.825 and more preferably no greater than 0.820. The $\rho_{15}$ values of the lubricating base oils (II) and (V) are preferably no greater than 0.835 and more preferably no greater than 0.830. Also, the $\rho_{15}$ values of the lubricating base oils (III) and (VI) are preferably no greater than 0.840 and more preferably no greater than 0.835.

The 15° C. density for the purpose of the invention is the density measured at 15° C. according to JIS K 2249-1995

The aniline point (AP (° C.)) of the lubricating base oil of the invention will also depend on the viscosity grade of the lubricating base oil, but it is preferably greater than or equal to the value of A as represented by the following formula (2), i.e., $AP \geqq A$.

$$A = 4.3 \times kv100 + 100 \quad (2)$$

[In this equation, kv100 represents the kinematic viscosity at 100° C. ($mm^2/s$) of the lubricating base oil.]

If $AP < A$, the viscosity-temperature characteristic, heat and oxidation stability, resistance to volatilization and low temperature viscosity property of the lubricating base oil will tend to be reduced, while the efficacy of additives when added to the lubricating base oil will also tend to be reduced.

The AP values of the lubricating base oils (I) and (IV), for example, are preferably 108° C. or higher and more preferably 110° C. or higher. The AP values of the lubricating base oils (II) and (V) are preferably 113° C. or higher and more preferably 119° C. or higher. The AP values of the lubricating base oils (III) and (VI) are preferably 125° C. or higher and more preferably 128° C. or higher. The aniline point for the purpose of the invention is the aniline point measured according to JIS K 2256-1985

The NOACK evaporation of the lubricating base oil of the invention is not particularly restricted, and for example, the NOACK evaporations of the lubricating base oils (I) and (IV) are preferably 20% by mass or greater, more preferably 25% by mass or greater and even more preferably 30% by mass or greater, and also preferably no greater than 50% by mass, more preferably no greater than 45% by mass and even more preferably no greater than 40% by mass. The NOACK evaporations of the lubricating base oils (II) and (V) are preferably 5% by mass or greater, more preferably 8% by mass or greater and even more preferably 10% by mass or greater, and also preferably no greater than 20% by mass, more preferably no greater than 16% by mass and even more preferably no greater than 15% by mass. The NOACK evaporations of the lubricating base oils (III) and (VI) are preferably 0% by mass or greater and more preferably 1% by mass or greater, and also preferably no greater than 6% by mass, more preferably no greater than 5% by mass and even more preferably no greater than 4% by mass. If the NOACK evaporations are below the aforementioned lower limits it will tend to be difficult to improve the low temperature viscosity property. If the NOACK evaporations are above the respective upper limits, the evaporation loss of the lubricating oil will be increased when the lubricating base oil is used as a lubricating oil for an internal combustion engine, and catalyst poisoning will be undesirably accelerated as a result. The NOACK evaporation for the purpose of the invention is the evaporation loss as measured according to ASTM D 5800-95.

The product of the kinematic viscosity at 40° C. (units: $mm^2/s$) and the NOACK evaporation (units: % by mass) of the lubricating base oils (II) and (V) is not particularly restricted, but it is preferably no greater than 250, more preferably no greater than 240, even more preferably no greater than 230, yet more preferably no greater than 220, even yet more preferably no greater than 210 and most preferably no greater than 200. Specifically, a smaller product of the kinematic viscosity at 40° C. (units: $mm^2/s$) and NOACK evaporation (units: % by mass) corresponds to a superior lubricating base oil which currently does not exist in the prior art, exhibiting low evaporation while having low viscosity.

The distillation properties of the lubricating base oil of the invention are preferably an initial boiling point (IBP) of 290-440° C. and a final boiling point (FBP) of 430-580° C. in gas chromatography distillation, and rectification of one or more fractions selected from among fractions in this distillation range can yield lubricating base oils (I)-(III) and (IV)-(VI) having the aforementioned preferred viscosity ranges.

For example, for the distillation properties of the lubricating base oils (I) and (IV), the initial boiling point (IBP) is preferably 260-340° C., more preferably 270-330° C. and even more preferably 280-320° C. Also, the 10% distillation temperature (T10) is preferably 310-390° C., more preferably 320-380° C. and even more preferably 330-370° C. The 50% running point (T50) is preferably 340-440° C., more preferably 360-430° C. and even more preferably 370-420° C. The 90% running point (T90) is preferably 405-465° C., more preferably 415-455° C. and even more preferably 425-445° C. The final boiling point (FBP) is preferably 430-490° C., more preferably 440-480° C. and even more preferably 450-490° C. T90-T10 is preferably 60-140° C., more preferably 70-130° C. and even more preferably 80-120° C. FBP-IBP is preferably 140-200° C., more preferably 150-190° C. and even more preferably 160-180° C. T10-IBP is preferably 40-100° C., more preferably 50-90° C. and even more preferably 60-80° C. FBP-T90 is preferably 5-60° C., more preferably 10-55° C. and even more preferably 15-50° C.

For the distillation properties of the lubricating base oils (II) and (V), the initial boiling point (IBP) is preferably 310-400° C., more preferably 320-390° C. and even more preferably 330-380° C. Also, the 10% distillation temperature (T10) is preferably 350-430° C., more preferably 360-420° C. and even more preferably 370-410° C. The 50% running point (T50) is preferably 390-470° C., more preferably 400-460° C. and even more preferably 410-450° C. The 90% running point (T90) is preferably 420-490° C., more preferably 430-480° C. and even more preferably 440-470° C. The final boiling point (FBP) is preferably 450-530° C., more preferably 460-520° C. and even more preferably 470-510° C. T90-T10 is preferably 40-100° C., more preferably 45-90° C. and even more preferably 50-80° C. FBP-IBP is preferably 110-170° C., more preferably 120-160° C. and even more preferably 130-150° C. T10-IBP is preferably 5-60° C., more preferably 10-55° C. and even more preferably 15-50° C. FBP-T90 is preferably 5-60° C., more preferably 10-55° C. and even more preferably 15-50° C.

For the distillation properties of the lubricating base oils (III) and (VI), the initial boiling point (IBP) is preferably 440-480° C., more preferably 430-470° C. and even more preferably 420-460° C. Also, the 10% distillation temperature (T10) is preferably 450-510° C., more preferably 460-500° C. and even more preferably 460-480° C. The 50% running point (T50) is preferably 470-540° C., more preferably 480-530° C. and even more preferably 490-520° C. The 90% running point (T90) is preferably 470-560° C., more preferably 480-550° C. and even more preferably 490-540° C. The final boiling point (FBP) is preferably 505-565° C., more preferably 515-555° C. and even more preferably 525-565° C. T90-T10 is preferably 35-80° C., more preferably 45-70° C. and even more preferably 55-80° C. FBP-IBP is preferably 50-130° C., more preferably 60-120° C. and even more preferably 70-110° C. T10-IBP is preferably 5-65° C., more preferably 10-55° C. and even more preferably 10-45° C. FBP-T90 is preferably 5-60° C., more preferably 5-50° C. and even more preferably 5-40° C.

By setting IBP, T10, T50, T90, FBP, T90-T10, FBP-IBP, T10-IBP and FBP-T90 within the preferred ranges specified above for lubricating base oils (I)-(VI), it is possible to further improve the low temperature viscosity and further reduce the evaporation loss. If the distillation ranges for T90-T10, FBP-IBP, T10-IBP and FBP-T90 are too narrow, the lubricating base oil yield will be poor resulting in low economy.

The IBP, T10, T50, T90 and FBP values for the purpose of the invention are the running points measured according to ASTM D 2887-97.

The residual metal content in the lubricating base oil of the invention derives from metals in the catalyst or starting materials that become unavoidable contaminants during the production process, and it is preferred to thoroughly remove such residual metals. For example, the Al, Mo and Ni contents are preferably no greater than 1 ppm by mass each. If the metal contents exceed these upper limits, the functions of additives in the lubricating base oil will tend to be inhibited.

The residual metal content for the purpose of the invention is the metal content as measured according to JPI-5S-38-2003.

The lubricating base oil of the invention preferably exhibits a RBOT life as specified below, correlating with its kinematic viscosity. The RBOT life of the lubricating base oils (I) and (IV), for example, is preferably 290 min or greater, more preferably 300 min or greater and even more preferably 310 min or greater. The RBOT life of the lubricating base oils (II) and (V) is preferably 350 min or greater, more preferably 360 min or greater and even more preferably 370 min or greater.

The RBOT life of the lubricating base oils (III) and (VI) is preferably 400 min or greater, more preferably 410 min or greater and even more preferably 420 min or greater. If the RBOT life of the lubricating base oil is less than the specified lower limit, the viscosity-temperature characteristic and heat and oxidation stability of the lubricating base oil will tend to be reduced, while the efficacy of additives when added to the lubricating base oil will also tend to be reduced.

The RBOT life for the purpose of the invention is the RBOT value as measured according to JIS K 2514-1996, for a composition obtained by adding a phenolic antioxidant (2,6-di-tert-butyl-p-cresol: DBPC) at 0.2% by mass to the lubricating base oil.

The lubricating base oil of the invention having the composition described above exhibits an excellent viscosity-temperature characteristic and low temperature viscosity property, while also having low viscosity resistance and stirring resistance and improved heat and oxidation stability and frictional properties, making it possible to achieve an increased friction reducing effect and thus improved energy savings. When additives are included in the lubricating base oil of the invention, the functions of the additives (improving the low temperature viscosity property with pour point depressants, improving heat and oxidation stability by antioxidants, increased friction reducing effect by friction modifiers, improved wear resistance by anti-wear agents, etc.) are exhibited at a higher level. The lubricating base oil of the invention can be suitably used as a base oil for a variety of lubricating oils. The specific use of the lubricating base oil of the invention may be in a lubricating oil for an internal combustion engine such as a passenger vehicle gasoline engine, two-wheel vehicle gasoline engine, diesel engine, gas engine, gas heat pump engine, ship engine, electric power engine or the like (internal combustion engine lubricating oil), in a lubricating oil for a drive transmission such as an automatic transmission, manual transmission, non-stage transmission, final reduction gear or the like (drive transmission oil), in a hydraulic oil for a hydraulic power unit such as a damper, construction machine or the like, or in a compressor oil, turbine oil, industrial gear oil, refrigerator oil, rust preventing oil, heating medium oil, gasholder seal oil, bearing oil, paper machine oil, machine tool oil, sliding guide surface oil, electrical insulation oil, shaving oil, press oil, rolling oil, heat treatment oil or the like, and using the lubricating base oil of the invention for these purposes will allow the improved characteristics of the lubricating oil including the viscosity-temperature characteristic, heat and oxidation stability, energy savings and fuel efficiency to be exhibited at a high level, together with a longer lubricating oil life and lower levels of environmentally unfriendly substances.

The lubricating oil composition of the invention may be used alone as a lubricating base oil according to the invention, or the lubricating base oil of the invention may be combined with one or more other base oils. When the lubricating base oil of the invention is combined with another base oil, the proportion of the lubricating base oil of the invention of the total mixed base oil is preferably at least 30% by mass, more preferably at least 50% by mass and even more preferably at least 70% by mass.

There are no particular restrictions on other base oils used in combination with the lubricating base oil of the invention, and as examples of mineral oil base oils there may be mentioned solvent refined mineral oils, hydrotreated mineral oils, hydrorefined mineral oils and solvent dewaxed base oils having kinematic viscosities at 100° C. of 1-100 $mm^2/s$.

As synthetic base oils there may be mentioned poly-α-olefins and their hydrogenated forms, isobutene oligomers and their hydrogenated forms, isoparaffins, alkylbenzenes, alkylnaphthalenes, diesters ditridecyl glutarate, di-2-ethylhexyl adipate, diisodecyladipate, ditridecyl adipate, di-2-ethylhexyl sebacate and the like), polyol esters (trimethylolpropane caprylate, trimethylolpropane pelargonate, pentaerythritol 2-ethylhexanoate, pentaerythritol pelargonate and the like), polyoxyalkylene glycols, dialkyldiphenyl ethers and polyphenyl ethers, among which poly-α-olefins are preferred. As typical poly-α-olefins there may be mentioned C2-32 and preferably C6-16 α-olefin oligomers or co-oligomers (1-octene oligomer, decene oligomer, ethylene-propylene co-oligomer and the like), as well as their hydrogenated forms.

There are no particular restrictions on the process for producing poly-α-olefins, and as examples there may be mentioned a process wherein an α-olefin is polymerized in the presence of a polymerization catalyst such as a Friedel-Crafts catalyst comprising a complex of aluminum trichloride or boron trifluoride with water, an alcohol (ethanol, propanol, butanol or the like) and a carboxylic acid or ester.

Preferred among other base oils for combination with a lubricating base oil of the invention are base oils having a viscosity index of at least 80, a % $C_P$ of at least 60 and a % $C_A$ of no greater than 10 (such a base oil will hereinafter referred to as "second lubricating base oil").

The viscosity index of the second lubricating base oil is preferably 100 or greater and more preferably 120 or greater, and also preferably no greater than 170 and more preferably no greater than 135, the % $C_P$ value is preferably 70 or greater and more preferably 75 or greater, and also preferably no greater than 100 and more preferably no greater than 85, the % $C_A$ value is preferably no greater than 3, more preferably no greater than 2 and even more preferably no greater than 1, and the CCS viscosity at −35° C. preferably exceeds 3000 mPa·s and more preferably 3500 mPa·s, and also is preferably no greater than 100,000 mPa·s, more preferably no greater than 50,000 mPa·s and even more preferably no greater than 15,000 mPa·s.

The kinematic viscosity at 100° C. of the second lubricating base oil is preferably 5 $mm^2/s$ or greater, more preferably 6 $mm^2/s$ or greater, and also preferably no greater than 35 $mm^2/s$, more preferably no greater than 20 $mm^2/s$, even more preferably no greater than 12 $mm^2/s$ and most preferably no greater than 8 $mm^2/s$. By using a second lubricating base oil with a kinematic viscosity at 100° C. of 5 $mm^2/s$ or greater, it will be easier to achieve a high anti-wear property in the presence of soot contamination, reduce evaporation loss and limit increase in viscosity to maintain low abrasiveness even with long-term use, while limiting the kinematic viscosity at 100° C. to no greater than 35 $mm^2/s$ can improve the cold-start property and the cold-start fuel efficiency.

There are no particular restrictions on the NOACK evaporation of the second lubricating base oil, but it is preferably 0-25% by mass, more preferably 2-15% by mass and most preferably 5-10% by mass. Selecting a second lubricating base oil with a NOACK evaporation within this range will make it easier to lower the evaporation loss and reduce the increase in viscosity to maintain low abrasiveness even with long-term use, while selecting one with a NOACK evaporation of 2% by mass or greater is especially preferred so that a lubricating oil composition with an excellent low temperature viscosity property can be more easily obtained.

The sulfur content of the second lubricating base oil is not particularly restricted, but it is preferably no greater than 1% by mass, more preferably no greater than 0.3% by mass, even more preferably no greater than 0.1% by mass and most preferably no greater than 0.01% by mass. By selecting a second lubricating base oil with a sulfur content below the aforementioned upper limit, it is possible to obtain a composition with even more excellent heat and oxidation stability, high-temperature detergency and low abrasiveness.

The iodine value of the second lubricating base oil is not particularly restricted, but from the viewpoint of achieving superior high-temperature detergency and reducing the wear or friction occurring with soot contamination, it is preferably no greater than 8 and more preferably no greater than 6, while from the viewpoint of economy of the production process it is preferably 0.01 or greater, more preferably 1 or greater and even more preferably 3 or greater.

When the lubricating base oil of the invention is used in combination with the aforementioned second lubricating base oil, the content of the second lubricating base oil is not particularly restricted but is preferably 10% by mass or greater, more preferably 20% by mass or greater and even more preferably 30% by mass or greater, and also preferably no greater than 90% by mass, more preferably no greater than 70% by mass and even more preferably no greater than 50% by mass, based on the total amount of the lubricating base oil.

When the lubricating base oil of the invention is used as a mixed base oil with another lubricating base oil (including a second lubricating base oil), the kinematic viscosity at 100° C. of the mixed base oil is adjusted to preferably 3-8 $mm^2/s$, more preferably 3.5-6 $mm^2/s$ and even more preferably 4-5.5 $mm^2/s$, and the viscosity index is preferably 110 or greater, more preferably 115 or greater, even more preferably 120 or greater and most preferably 125 or greater. The sulfur content of the mixed base oil is not particularly restricted but is preferably no greater than 0.3% by mass, and from the viewpoint of further improving the extended life performance including base value retention, it is preferably no greater than 0.1% by mass, more preferably no greater than 0.05% by mass and even more preferably no greater than 0.005% by mass. There are no particular restrictions on the NOACK evaporation of the mixed base oil, but it is preferably 5-25% by mass, more preferably 10-20% by mass and most preferably 12-15% by mass. There are also no particular restrictions on the low temperature viscosity property of the mixed base oil, but the −30° C. CCS viscosity is preferably no greater than 20,000 mPa·s, more preferably no greater than 7000 mPa·s and even more preferably no greater than 3500 mPa·s. The CCS viscosity is the viscosity at the specified temperature as measured according to JIS K 2010.

Specified amounts of a (A) ashless friction modifier and (B) phosphorus-containing anti-wear agent may be added to the lubricating base oil of the invention and the other lubricating base oil used as necessary, in a lubricating oil composition of the invention.

The (A) ashless friction modifier used may be any compound ordinarily used as an ashless friction modifier for lubricating oils, and as examples there may be mentioned ashless friction modifiers that are amine compounds, imide compounds, fatty acid esters, fatty acid amides, fatty acids, aliphatic alcohols, aliphatic ethers and the like having one or more C6-30 hydrocarbon, preferably alkyl or alkenyl and especially C6-30 straight-chain alkyl or straight-chain alkenyl groups in the molecule, or ashless friction modifiers comprising C1-30 hydrocarbon groups and two or more nitrogen atoms. According to the invention, the preferred ashless friction modifiers among those mentioned above are ashless friction modifiers having ester bonds or amide bonds, ashless friction modifiers having three or more atoms selected from among nitrogen, oxygen and sulfur, and ashless friction modifiers selected from among compounds having two or more nitrogen atoms and oxygen atom and/or sulfur atoms, among which amide bond-containing ashless friction modifiers are especially preferred.

Examples of amine compounds include C6-30 straight-chain or branched and preferably straight-chain aliphatic monoamines and straight-chain or branched and preferably straight-chain aliphatic polyamines, or alkyleneoxide addition products of aliphatic amines. Examples of fatty acid esters include esters of C7-31 straight-chain or branched and preferably straight-chain fatty acids with aliphatic monohydric alcohols or aliphatic polyhydric alcohols. Examples of fatty acid amides include amides of C7-31 straight-chain or branched and preferably straight-chain fatty acids with aliphatic monoamines or aliphatic polyamines.

As preferred examples of ashless friction modifiers having three or more atoms selected from among nitrogen, oxygen and sulfur there may be mentioned esters of trihydric or greater polyhydric alcohols such as glycerin or sorbitan with fatty acids such as oleic acid, as well as the compounds having two or more nitrogen atoms and oxygen atom and/or sulfur atoms which are mentioned below.

As ashless friction modifiers selected from among compounds having two or more nitrogen atoms in combination with oxygen atoms and/or sulfur atoms, there may be mentioned compounds having 2-10, preferably 2-4 and most preferably 2 nitrogen atoms with 1-4 and preferably 1-2 oxygen and/or sulfur atoms (preferably oxygen atoms), among which those also having amide bonds are preferred. Of these examples there may be mentioned more specifically the hydrazides (hydrazide oleate, etc.), semicarbazides (oleylsemicarbazide, etc.), ureas (oleylurea, etc.), ureidos (oleylureido, etc.) and allophanic acid amides (oleylallophanic acid amide, etc.), and their derivatives, which are mentioned in International Patent Publication No. 2005/037967. Especially preferred among these are one or more compounds selected from the group consisting of nitrogen-containing compounds represented by the following general formula (1) and (2) and their acid-modified derivatives.

[Chemical Formula 1]

(1)

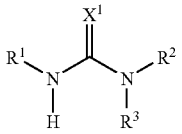

In general formula (1), $R^1$ is a C1-30 hydrocarbon or functional C1-30 hydrocarbon group, preferably a C10-30 hydrocarbon group or functional C10-30 hydrocarbon group, more preferably a C12-24 alkyl, alkenyl or functional hydrocarbon group and most preferably a C12-20 alkenyl group, $R^2$ and $R^3$ each separately represent a C1-30 hydrocarbon group, functional C1-30 hydrocarbon group or hydrogen, preferably a C1-10 hydrocarbon group, functional C1-10 hydrocarbon group or hydrogen, even more preferably a C1-4 hydrocarbon group or hydrogen and most preferably hydrogen, and $X^1$ represents oxygen or sulfur and preferably oxygen. Most preferred examples of nitrogen-containing compounds represented by general formula (1) include, specifically, compounds wherein $X^1$ is oxygen and acid-modified derivatives thereof, and more specifically, urea compounds with C12-24 alkyl or alkenyl groups such as dodecylurea, tridecylurea, tetradecylurea, pentadecylurea, hexadecylurea, heptadecylurea, octadecylurea and oleylurea, wherein $X^1$ is oxygen, $R^1$ is a C12-24 alkyl or alkenyl group and $R^2$ and $R^3$ are hydrogen, as well as their acid-modified derivatives. Particularly preferred examples among the above include oleylurea ($C_{18}H_{35}$—NH—C(=O)—$NH_2$) and its acid-modified derivatives (boric acid-modified derivatives and the like).

[Chemical Formula 2]

(2)

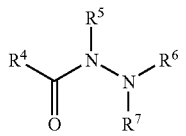

In general formula (2), $R^4$ is a C1-30 hydrocarbon or functional C1-30 hydrocarbon group, preferably a C10-30 hydrocarbon group or functional C10-30 hydrocarbon group, more preferably a C12-24 alkyl, alkenyl or functional hydrocarbon group and most preferably a C12-20 alkenyl group, $R^5$-$R^7$ each separately represent a C1-30 hydrocarbon group, functional C1-30 hydrocarbon group or hydrogen, preferably a C1-10 hydrocarbon group, functional C1-10 hydrocarbon group or hydrogen, even more preferably a C1-4 hydrocarbon group or hydrogen, and most preferably hydrogen.

Nitrogen-containing compounds represented by general formula (2) include, specifically, hydrazides with C1-30 hydrocarbon or functional C1-30 hydrocarbon groups, and their derivatives. When $R^4$ is a C1-30 hydrocarbon or functional C1-30 hydrocarbon group and $R^5$-$R^7$ are hydrogen, the compound will be a hydrazide with a C1-30 hydrocarbon or functional C1-30 hydrocarbon group, and when any of $R^4$ and $R^5$-$R^7$ is a C1-30 hydrocarbon or functional C1-30 hydrocarbon group while the remaining groups of $R^5$-$R^7$ are hydrogen, it will be an N-hydrocarbylhydrazide with a C1-30 hydrocarbon or functional C1-30 hydrocarbon group (where the hydrocarbyl is a hydrocarbon group). The most preferred examples of nitrogen-containing compounds represented by general formula (2) are hydrazide compounds having C12-24 alkyl or alkenyl groups such as dodecanoyl hydrazide, tridecanoyl hydrazide, tetradecanoyl hydrazide, pentadecanoyl hydrazide, hexadecanoyl hydrazide, heptadecanoyl hydrazide, octadecanoyl hydrazide, oleyl hydrazide, erucoyl hydrazide and the like, wherein $R^4$ is a C12-24 alkyl or alkenyl group and $R^5$, $R^6$ and $R^7$ are hydrogen, as well as acid-modified derivatives (for example, boric acid-modified derivatives) thereof. As particularly preferred examples among the above there may be mentioned oleyl hydrazide ($C_{17}H_{33}$—C(=O)—NH—$NH_2$) and its acid-modified derivatives, and erucoyl hydrazide ($C_{21}H_{41}$—C(=O)—NH—$NH_2$) and its acid-modified derivatives.

The production process for ashless friction modifiers having two or more nitrogen atoms in the molecule, and preferred modes thereof, are described in detail in International Patent Publication No. 2005/037967, and if necessary they may be added to the lubricating oil composition of the invention in the form of complexes or salts with organometallic compounds. Ashless friction modifiers having two or more nitrogen atoms in the molecule together with oxygen and/or sulfur atoms are especially preferred because they can exhibit friction reducing effects equivalent or superior to those of friction reducers that have been used in the prior art, such as molybdenum dithiocarbamate, and easily maintain their effects for long periods without loss of the friction reducing effect even in the presence of soot contamination.

The content of the (A) ashless friction modifier in the lubricating oil composition of the invention is 0.01-10% by mass, preferably 0.1% by mass or greater and more preferably 0.3% by mass or greater, and also preferably no greater than 3% by mass, more preferably no greater than 2% by mass and even more preferably no greater than 1% by mass, based on the total amount of the composition. If the ashless friction modifier content is less than 0.01% by mass the friction reducing effect by the addition will tend to be insufficient, while if it is greater than 10% by mass, the effects of the wear resistance additives may be inhibited, or the solubility of the additives may be reduced.

Component (B) in the lubricating oil composition of the invention is a phosphorus-containing anti-wear agent. The phosphorus-containing anti-wear agent is not particularly restricted so long as it is an anti-wear agent containing phosphorus in the molecule, and for example, it is preferably at least one compound selected from the group consisting of phosphorus compounds represented by general formula (3), phosphorus compounds represented by general formula (4), as well as their metal salts and amine salt, and derivatives of the foregoing.

[Chemical Formula 3]

(3)

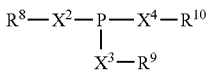

In formula (3), $X^2$, $X^3$ and $X^4$ each separately represent an oxygen atom or sulfur atom, and $R^8$, $R^9$ and $R^{10}$ each separately represent hydrogen or a $C_{1-30}$ hydrocarbon-containing group.

[Chemical Formula 4]

(4)

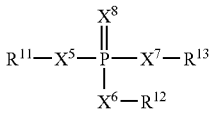

In formula (4), $X^5$, $X^6$, $X^7$ and $X^8$ each separately represent an oxygen atom or sulfur atom (with one or two of $X^5$, $X^6$ and $X^7$ optionally being a single bond or (poly)oxyalkylene group), and $R^{11}$, $R^{12}$ and $R^{13}$ each separately represent hydrogen or a C1-30 hydrocarbon-containing group.

As C1-30 hydrocarbon-containing groups represented by $R^8$-$R^{13}$ there may be mentioned hydrocarbon-containing groups with hydrocarbon groups such as alkyl, cycloalkyl, alkenyl, alkyl-substituted cycloalkyl, aryl, alkyl-substituted aryl and arylalkyl, the hydrocarbon groups being preferably C1-30 alkyl or C6-24 aryl groups, more preferably C3-18 and even more preferably C4-12 alkyl groups. These hydrocarbon-containing groups may contain a hydrocarbon group and an oxygen atom, nitrogen atom or sulfur atom in the molecule, and hydrocarbon groups composed of carbon and hydrogen are preferred.

As examples of phosphorus compounds represented by general formula (3) there may be mentioned phosphorous acid, monothiophosphorous acid, dithiophosphorous acid and trithiophosphorous acid; phosphorous acid monoesters, monothiophosphorous acid monoesters, dithiophosphorous acid monoesters and trithiophosphorous acid monoesters with one C1-30 hydrocarbon group; phosphorous acid diesters, monothiophosphorous acid diesters, dithiophosphorous acid diesters and trithiophosphorous acid diesters with two C1-30 hydrocarbon groups; and phosphorous acid triesters, monothiophosphorous acid triesters, dithiophosphorous acid triesters and trithiophosphorous acid triesters with three C1-30 hydrocarbon groups, as well as mixtures of the foregoing.

As examples of phosphorus compounds represented by general formula (4) there may be mentioned phosphoric acid, monothiophosphoric acid, dithiophosphoric acid, trithiophosphoric acid and tetrathiophosphoric acid; phosphoric acid monoesters, monothiophosphoric acid monoesters, dithiophosphoric acid monoesters, trithiophosphoric acid monoesters and tetrathiophosphoric acid monoesters with one C1-30 hydrocarbon group; phosphoric acid diesters, monothiophosphoric acid diesters, dithiophosphoric acid diesters, trithiophosphoric acid diesters and tetrathiophosphoric acid diesters with two C1-30 hydrocarbon groups; phosphoric acid triesters, monothiophosphoric acid triesters, dithiophosphoric acid triesters, trithiophosphoric acid triesters and tetrathiophosphoric acid triesters with three C1-30 hydrocarbon groups; phosphonic acid, phosphonic acid monoesters and phosphonic acid diesters with 1-3 C1-30 hydrocarbon groups; the aforementioned phosphorus compounds with C1-4 (poly)oxyalkylene groups; and derivatives of the aforementioned phosphorus compounds obtained by reaction between β-dithiophosphorylated propionic acid or dithiophosphoric acid and olefincyclopentadiene or (methyl) methacrylic acid, as well as mixtures of the foregoing.

As salts of phosphorus compounds represented by general formula (3) or (4) there may be mentioned salts obtained by reacting metal bases such as metal oxides, metal hydroxides, metal carbonates, metal chlorides and the like, or nitrogen compounds such as ammonia and amine compounds containing only C1-30 hydrocarbon or hydroxyl group-containing hydrocarbon groups in the molecule, with the phosphorus compounds, and neutralizing all or a portion of the residual acidic hydrogens.

As metals for the metal base there may be mentioned, specifically, alkali metals such as lithium, sodium, potassium and cesium, alkaline earth metals such as calcium, magnesium and barium, and heavy metals such as zinc, copper, iron, lead, nickel, silver and manganese. Preferred among these are alkaline earth metals such as calcium and magnesium, and zinc.

As the nitrogen compound there may be mentioned, specifically, ammonia, monoamine, diamine, polyamine and the like, and more specifically, the same amine compounds in the amine complexes with molybdenum described hereunder in regard to component (E2).

Preferred examples among these nitrogen compounds include C10-20 alkyl- or alkenyl group-containing aliphatic amines (which may be straight-chain or branched), such as decylamine, dodecylamine, dimethyldodecylamine, tridecylamine, heptadecylamine, octadecylamine, oleylamine and stearylamine.

For the phosphorus-containing anti-wear agent as component (B) according to the invention there is particularly preferred an agent composed mainly of at least one compound selected from among (B1)-(B3), added to the lubricating oil composition of the invention.

(B1) Zinc dialkyldithiophosphates having a secondary alkyl group selected from among C3-8 groups.

(B2) Zinc dialkyldithiophosphates having a primary alkyl group selected from among C3-8 groups.

(B3) Metal salts of sulfur-free phosphorus-containing acids.

The compounds represented by general formula (5) below are examples of components (B1) and (B2).

[Chemical Formula 5]

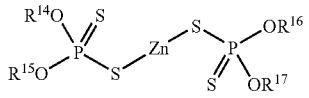

(5)

In this formula, $R^{14}$, $R^{15}$, $R^{16}$ and $R^{17}$ may be the same or different and each separately represents a C3-8 secondary alkyl or primary alkyl and preferably C3-6 secondary alkyl or C6-8 primary alkyl group, and they may have alkyl groups with different numbers of carbon atoms and different structures of alkyl groups (secondary or primary) in the same molecule.

According to the invention, from the viewpoint of helping to reduce wear in the presence of soot contamination even with a low concentration it is preferred to add (B1) a zinc dialkyldithiophosphate having a C3-8 secondary alkyl group, from the viewpoint of further improving the oxidation stability and significantly increasing the base value retention it is preferred to add (B2) a zinc dialkyldithiophosphate with a C3-8 primary alkyl group, and from the viewpoint of achieving a satisfactory balance with high levels of both reduced wear in the presence of soot contamination and base value retention it is most preferred to add both components (B1) and (B2).

Any desired method of the prior art may be used to produce the zinc dithiophosphate without any particular restrictions, but a specific example is synthesis by reaction of diphosphorus pentasulfide with an alcohol comprising alkyl groups corresponding to $R^{14}$, $R^{15}$, $R^{16}$ and $R^{17}$ to produce a dithiophosphoric acid, and neutralizing this with zinc oxide.

Component (B3) is a metal salt of a sulfur-free phosphorus-containing acid, and as representative examples there may be mentioned metal salts of phosphorus compounds wherein all of $X^2$-$X^4$ in general formula (3) are oxygen atoms (one or two of $X^2$, $X^3$ and $X^4$ may also be a single bond or (poly)oxyalkylene group), and metal salts of phosphorus compounds wherein all of $X^5$-$X^8$ in general formula (4) are oxygen atoms (one or two of $X^5$, $X^6$ and $X^7$ may be a single bond or (poly) oxyalkylene group). These examples of component (B3) are preferred for use from the viewpoint of achieving a marked increase in high-temperature detergency, and long drain performance including oxidation stability and base value retention.

The aforementioned metal salts of phosphorus compounds will have different structures depending on the valency of the metal and the number of OH groups in the phosphorus compound, and consequently there are no restrictions on their structures. For example, when 1 mol of zinc oxide is reacted with 2 mol of phosphoric acid diester (one OH group), a compound having the structure represented by the following general formula (6) may be obtained as the major component, although polymerized molecules may also be present.

[Chemical Formula 6]

(6)

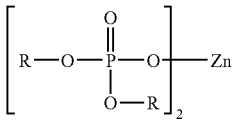

Or when 1 mol of zinc oxide is reacted with 1 mol of phosphoric acid monoester (two OH groups), for example, a compound having the structure represented by the following general formula (7) may be obtained as the major component, although polymerized molecules may also be present.

[Chemical Formula 7]

(7)

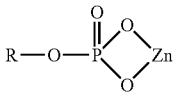

Preferred among these examples of component (B3) are salts of zinc with phosphorous acid diesters having two C3-18 alkyl or aryl groups, salts of zinc with phosphoric acid monoesters having one C3-18 alkyl or aryl group, salts of zinc with phosphoric acid diesters having two C3-18 alkyl or aryl groups, and salts of zinc with phosphonic acid monoesters having two C1-18 alkyl or aryl groups. These components may be used alone or in any desired combination of two or more. From the viewpoint of achieving a more excellent anti-wear property against soot contamination according to the invention, metal salts of alkylphosphoric acid esters with one or two C4-12 alkyl groups are preferred, metal salts of mono and/or dialkylphosphoric acid esters with one or two C6-8 alkyl groups are more preferred, and zinc mono- and di-2-ethylhexylphosphates are most preferred.

The upper limit for the content of phosphorus-containing anti-wear agents in the lubricating oil composition of the invention, and preferably the content of at least one of the components selected from among (B1), (B2) and (B3), is no greater than 0.2% by mass, preferably no greater than 0.1% by mass, more preferably no greater than 0.08% by mass and most preferably no greater than 0.06% by mass as phosphorus, while the lower limit is 0.01% by mass or greater, preferably 0.02% by mass or greater and most preferably 0.04% by mass or greater as phosphorus, from the viewpoint of helping to reduce wear in the presence of soot contamination.

The phosphorus-containing anti-wear agent content preferably does not exceed 0.2% by mass as phosphorus because the high-temperature detergency and base value retention will be significantly impaired, and a range of 0.09-0.2% by mass is preferred from the viewpoint of avoiding notable wear even in the presence of soot contamination, while the content is preferably no greater than 0.08% by mass from the viewpoint of achieving lower sulfur and phosphorus and further increasing the high-temperature detergency and base value retention.

The lubricating oil composition of the invention comprises the aforementioned lubricating base oil of the invention, (A) ashless friction modifier and (B) phosphorus-containing anti-wear agent, but to further increase its performance, or as needed for the purpose or required performance of the lubricating oil composition, it is preferred to add one or more compounds selected from among (C) metallic detergents, (D) non-ash powders and (E) organic molybdenum compounds.

Component (C) in the lubricating oil composition of the invention is a metallic detergent. Specifically there may be mentioned sulfonate-based detergents, phenate-based cleaning agents, salicylate-based cleaning agents and carboxylate-based cleaning agents, any of which are suitable for use. According to the invention, sulfonate-based cleaning agents are particularly preferred for use from the viewpoint of achieving a highly superior anti-wear property in the presence of soot contamination.

There are no particular restrictions on the structure of the sulfonate-based cleaning agent, and as examples there may be mentioned alkali metal salts or alkaline earth metal salts of alkylaromatic sulfonic acids obtained by sulfonation of alkyl aromatic compounds with molecular weights of 100-1500 and preferably 200-700, among which magnesium salts and/or calcium salts are preferred, and specific alkylaromatic sulfonic acids to be used include petroleum sulfonic acids or synthetic sulfonic acids. As petroleum sulfonic acids there may be used sulfonated alkyl aromatic compounds from mineral oil lube-oil distillates, or "mahogany acids" that are by-products of white oil production. Examples of synthetic sulfonic acids that may be used include sulfonated products of alkylbenzenes with straight-chain or branched alkyl groups, either as by-products of alkylbenzene production plants that are used as starting materials for detergents or obtained by alkylation of polyolefins onto benzene, or sulfonated dinonylnaphthalenes. There are no particular restrictions on the sulfonating agent used for sulfonation of these alkyl aromatic compounds, but for most purposes fuming sulfuric acid or sulfuric acid may be used.

For alkylation of aromatic sulfonic acids, it is preferred to use straight-chain or branched (poly)olefins, for example, oligomers of C2-4 olefins such as ethylene, propylene or butene, among which ethylene oligomers are particularly preferred. Alkali metal salts or alkaline earth metal salts of alkylaromatic sulfonic acids alkylated using C6-40 straight-chain α-olefins derived from ethylene oligomers can notably increase the friction reducing effect. As C6-40 straight-chain α-olefins there may be mentioned C10-30 and preferably C14-20 or C20-30 straight-chain α-olefins, among which C20-26 straight-chain α-olefins are preferred from the viewpoint of achieving a highly superior friction reducing effect of the obtained sulfonate.

Sulfonate-based cleaning agents include not only neutral alkaline earth metal sulfonates obtained by reacting the aforementioned alkylaromatic sulfonic acids directly with alkaline earth metal bases such as oxides or hydroxides of the alkaline earth metals magnesium and/or calcium, or by forming alkali metal salts such as sodium salts or potassium salts therewith and then substituting them with alkaline earth metal salts, basic alkaline earth metal sulfonates obtained by heating the aforementioned neutral alkaline earth metal sulfonates with an excess of an alkaline earth metal salt or alkaline earth metal base (hydroxide or oxide) in the presence of water, but also carbonated overbased alkaline earth metal sulfonates and borated overbased alkaline earth metal sulfonates obtained by reacting the aforementioned neutral alkaline earth metal sulfonates with alkaline earth metal bases in the presence of carbon dioxide gas and/or boric acid or a boric acid salt.

As sulfonate-based cleaning agents for the invention there may be used the aforementioned neutral alkaline earth metal sulfonates, basic alkaline earth metal sulfonates, overbased alkaline earth metal sulfonates, or mixtures thereof.

As the sulfonate-based cleaning agent according to the invention there are preferred calcium sulfonate-based cleaning agents and magnesium sulfonate-based cleaning agents, among which calcium sulfonate-based cleaning agents are most preferably used.

Sulfonate-based cleaning agents are generally marketed or otherwise available in forms diluted with light lubricating base oils, and for most purposes the metal content will be 1.0-20% by mass and preferably 2.0-16% by mass.

The sulfonate-based cleaning agent used for the invention may have any base value, usually in the range of 0-500 mgKOH/g, but the base value is preferably 100-450 mgKOH/g and more preferably 200-400 mgKOH/g from the viewpoint of obtaining an excellent improving effect on the high-temperature detergency with respect to content.

The base value referred to here is the base value determined by the perchloric acid method, as measured according to JIS K2501: "Petroleum Product And Lubricating Oils—Neutralization Value Test Method", Section 7.

There are no particular restrictions on the structure of salicylate-based cleaning agents, and there may be used metal salts, preferably alkali metal salts or alkaline earth metal salts and especially magnesium salts and/or calcium salts of salicylic acids with 1-2 C1-40 alkyl groups.

From the viewpoint of an excellent low temperature viscosity property, a salicylate-based cleaning agent used in the lubricating oil composition of the invention preferably has a high monoalkylsalicylic acid metal salt composition ratio, such as a monoalkylsalicylic acid metal salt composition ratio of 85-100 mol % and a dialkylsalicylic acid metal salt composition ratio of 0-15 mol %, and especially preferred are alkylsalicylic acid metal salts and/or (over)basic salts with a 3-alkylsalicylic acid metal salt composition ratio of 40-100 mol %. Salicylate-based cleaning agents containing dialkylsalicylic acid metal salts are preferred for the invention from the viewpoint of excellent high-temperature detergency and base value retention.

A "monoalkylsalicylic acid metal salt" is an alkylsalicylic acid metal salt with one alkyl group, such as a 3-alkylsalicylic acid metal salt, 4-alkylsalicylic acid metal salt or 5-alkylsalicylic acid metal salt, and the monoalkylsalicylic acid metal salt composition ratio is 85-100 mol %, preferably 88-98 mol % and even more preferably 90-95 mol % with respect to 100 mol % of the total alkylsalicylic acid metal salts, while the composition ratio of alkylsalicylic acid metal salts other than monoalkylsalicylic acid metal salts, such as dialkylsalicylic acid metal salts, is 0-15 mol %, preferably 2-12 mol % and even more preferably 5-10 mol %. The 3-alkylsalicylic acid metal salt composition ratio is 40-100 mol %, preferably 45-80 mol % and even more preferably 50-60 mol % with respect to 100 mol % of the alkylsalicylic acid metal salts. The total composition ratio of 4-alkylsalicylic acid metal salts and 5-alkylsalicylic acid metal salts corresponds to the composition ratio minus the 3-alkylsalicylic acid metal salts and dialkylsalicylic acid metal salts, and is 0-60 mol %, preferably 20-50 mol % and even more preferably 30-45 mol % with respect to 100 mol % of the total alkylsalicylic acid metal salts. Including a small amount of a dialkylsalicylic acid metal salt can yield a composition with excellent high-temperature detergency, low-temperature characteristics and also base value retention, while a 3-alkylsalicylate composition ratio of 40 mol % or greater can produce a relatively low 5-alkylsalicylic acid metal salt composition ratio, thereby improving the oil solubility.

The alkyl groups of the alkylsalicylic acid metal salts in the salicylate-based cleaning agent are C10-40, preferably C10-19 or C20-30, even more preferably C14-18 or C20-26 and most preferably C14-18 alkyl groups. As C10-40 alkyl groups there may be mentioned C10-40 alkyl groups such as decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl groups. These alkyl groups may be straight-chain or branched and primary alkyl, secondary alkyl or tertiary alkyl groups, although secondary alkyl groups are especially preferred for the invention from the viewpoint of more easily obtaining the aforementioned salicylic acid metal salts.

As metals for alkylsalicylic acid metal salts there may be mentioned alkali metals such as sodium and potassium and alkaline earth metals such as calcium and magnesium, among which calcium and magnesium are preferred and calcium is particularly preferred.

The salicylate-based cleaning agent may be produced by a publicly known process without any particular restrictions, and for example, it may be obtained by reacting an alkylsalicylic acid, composed mainly of a monoalkylsalicylic acid obtained by a method of alkylation of 1 mol of phenol with 1 mol or more of a C10-40 olefin such as polymer or copolymer of ethylene, propylene or butene, and preferably a straight-chain α-olefin such as an ethylene polymer, followed by carboxylation with carbon dioxide gas or the like, or a method of alkylation of 1 mol of salicylic acid with 1 mol or more of such an olefin, and preferably a straight-chain α-olefin, with a metal base such as an alkali metal or alkaline earth metal oxide or hydroxide, or an alkali metal salt such as a sodium salt or potassium salt with subsequent substitution of the alkali metal salt with an alkaline earth metal salt. The reaction ratio of the phenol or salicylic acid and olefin is preferably controlled to, for example, 1:1-1.15 (molar ratio) and more preferably 1:1.05-1.1 (molar ratio) to adjust the monoalkylsalicylic acid metal salt and dialkylsalicylic acid metal salt composition ratio to the desired proportion, and using a straight-chain α-olefin as the olefin is particularly preferred because it can facilitate control of the composition ratio of the 3-alkylsalicylic acid metal salt, 5-alkylsalicylic acid metal salt, etc. to the desired proportion while yielding a product composed mainly of alkylsalicylic acid metal salts with secondary alkyl groups as is preferred according to the invention. When a branched olefin is used as the olefin it will be easier to obtain a product consisting almost entirely of 5-alkylsalicylic acid metal salts, but it will be necessary to improve the oil solubility by combination with 3-alkylsalicylic acid metal salts as according to the preferred construction of the invention, thus complicating the production process, and therefore this method is not preferred.

Salicylate-based cleaning agents that may be suitably used in the lubricating oil composition of the invention include, in addition to alkali metal or alkaline earth metal salicylates (neutral salts) obtained in the manner described above, also basic salts obtained by heating an excess of alkali metal or alkaline earth metal salts or alkali metal or alkaline earth metal bases (alkali metal or alkaline earth metal hydroxides or oxides) in the presence of water, and overbased salts obtained by reacting the aforementioned neutral salts with bases such as alkali metal or alkaline earth metal hydroxides in the presence of carbon dioxide gas, boric acid or borates.

These reactions are usually carried out in solvents (aliphatic hydrocarbon solvents such as hexane, aromatic hydrocarbon solvents such as xylene or light lubricating base oils), and the preferred metal content is 1.0-20% by mass and more preferably 2.0-16% by mass.

From the viewpoint of achieving an excellent balance of high-temperature detergency, base value retention and low temperature viscosity property, the most preferred salicylate-based cleaning agents for the invention are alkylsalicylic acid metal salts with monoalkylsalicylic acid metal salt composition ratios of 85-95 mol %, dialkylsalicylic acid metal salt composition ratios of 5-15 mol %, 3-alkylsalicylic acid metal salt composition ratios of 50-60 mol % and 4-alkylsalicylic acid metal salt/5-alkylsalicylic acid metal salt composition ratios of 35-45 mol %, and/or their (over)basic salts. Secondary alkyl groups are particularly preferred as the alkyl groups.

According to the invention, the base value of the salicylate-based cleaning agent will normally be 0-500 mgKOH/g but is preferably 20-300 mgKOH/g and most preferably 100-200 mgKOH/g, and two or more selected from among the above may be used in combination. The base value referred to here is the base value determined by the perchloric acid method, as measured according to JIS K2501: "Petroleum Product And Lubricating Oils—Neutralization Value Test Method", Section 7.

As phenate-based cleaning agents there may be used, specifically, alkaline earth metal salts, and especially magnesium salts and/or calcium salts, of alkylphenolsulfides obtained by reacting sulfur with alkylphenols containing at least one C4-40 and preferably C6-18 straight-chain or branched alkyl group, or alkylphenol Mannich reaction products obtained by reacting the alkylphenols with formaldehyde.

Phenate-based cleaning agents include, in addition to alkali metal or alkaline earth metal phenates (neutral salts) obtained in the manner described above, also basic salts obtained by heating an excess of alkali metal or alkaline earth metal salts or alkali metal or alkaline earth metal bases (alkali metal or alkaline earth metal hydroxides or oxides) in the presence of water, and overbased salts obtained by reacting the aforementioned neutral salts with bases such as alkali metal or alkaline earth metal hydroxides in the presence of carbon dioxide gas, boric acid or borates.

These reactions are usually carried out in solvents (aliphatic hydrocarbon solvents such as hexane, aromatic hydrocarbon solvents such as xylene or light lubricating base oils), and the preferred metal content is 1.0-20% by mass and more preferably 2.0-16% by mass.

The base value of the phenate-based cleaning agent will usually be 0-500 mgKOH/g and preferably 20-450 mgKOH/g.

There are no particular restrictions on the metal ratios of these metallic detergents, which will usually be 1-40, but according to the invention at least one agent with a metal ratio of preferably 2 or greater, more preferably 3 or greater and most preferably 6 or greater is added from the viewpoint of preventing wear in the presence of soot contamination. From the viewpoint of stability, the metal ratio is preferably no greater than 20 and more preferably no greater than 15. The metal ratio referred to here is represented by:

Valency of metal element in metallic detergent×metal element content (mol %)/soap content(mol %)

(where "soap group" is the counter organic group forming the metal salt and represents a sulfonic acid-containing group, salicylic acid-containing group or phenol-containing group).

According to the invention, from the viewpoint of achieving a more excellent anti-wear property in the presence of soot contamination it is preferred to add a sulfonate-based cleaning agent and/or phenate-based cleaning agent with a metal ratio of 6 or greater and preferably 8-15, while from the viewpoint of further improving the low abrasiveness and high-temperature detergency it is preferred to add a metallic detergent, particularly a sulfonate-based cleaning agent and/or salicylate-based cleaning agent and especially a sulfonate-based cleaning agent, with a metal ratio of less than two and preferably no greater than 1.5, it is more preferred to use a sulfonate-based cleaning agent and/or phenate-based cleaning agent with a metal ratio of 6 or greater in combination with a sulfonate-based cleaning agent and/or salicylate-based cleaning agent with a metal ratio of less than 2, and it is most preferred to use a sulfonate-based cleaning agent with a metal ratio of 6 or greater in combination with a sulfonate-based cleaning agent with a metal ratio of less than 2.

The content of component (C) in the lubricating oil composition of the invention is 0.01-1% by mass, preferably 0.05-0.5% by mass, more preferably 0.1-0.3% by mass and even more preferably 0.15-0.25% by mass as metal based on the total amount of the lubricating oil composition.

When a sulfonate-based cleaning agent and/or phenate-based cleaning agent with a metal ratio of 6 or greater is used in combination with a sulfonate-based cleaning agent and/or salicylate-based cleaning agent with a metal ratio of less than 2 as component (C), there are no particular restrictions on their content ratio, but for the same reason explained above, it is preferably 0.001-0.5, more preferably 0.01-0.3, even more preferably 0.05-0.2 and most preferably 0.08-0.12, in terms of the mass ratio of the metal from the sulfonate-based cleaning agent and/or salicylate-based cleaning agent with a metal ratio of less than 2 (M2) with respect to the total amount of the metal from the sulfonate-based cleaning agent and/or phenate-based cleaning agent with a metal ratio of 6 or greater (M1) and the metal from the sulfonate-based cleaning agent and/or salicylate-based cleaning agent with a metal ratio of less than 2 (M2), i.e. M2/(M1+M2).

Component (D) according to the invention is a non-ash powder. As non-ash powders there may be mentioned nitrogen-containing compounds such as succinic acid imides, benzylamines, polyamines, Mannich bases and the like comprising polyolefin-derived alkenyl or alkyl groups, and derivatives obtained by reacting boron compounds such as boric acid and boric acid salts, phosphorus compounds such as (thio)phosphoric acid and (thio)phosphoric acid salts, organic acids, hydroxy(poly)oxyalkylene carbonates or the like with the aforementioned nitrogen-containing compounds.

According to the invention, one or more selected from among any of the above may be added. The alkenyl group or alkyl group in this case may be straight-chain or branched, and as specific preferred groups there may be mentioned branched alkyl groups or branched alkenyl groups derived from oligomers of olefins such as propylene, 1-butene or isobutylene or co-oligomers of ethylene and propylene, and especially preferred are branched alkyl groups or branched alkenyl groups derived from polybutene (polyisobutene) with a number-average molecular weight of 700-5000 and especially 900-5000.

The weight-average molecular weight of a non-ash powder used for the invention must be 3000-20,000, and preferably the weight-average molecular weight of the non-ash powder is 4000-15,000. If the weight-average molecular weight is less than 3000, the molecular weight of the non-polar polybutenyl groups will be reduced resulting in poor sludge dispersancy and the number of amine portions of polar groups that can act as active sites for oxidative degradation will be relatively greater, thus impairing the oxidation stability; however, from the viewpoint of preventing loss of low temperature viscosity property the weight-average molecular weight is preferably no greater than 20,000 and even more preferably no greater than 15,000. The weight-average molecular weight referred to here is the weight-average molecular weight based on polystyrene, as measured using a 150-CALC/GPC by Japan Waters Co., equipped with two GMHHR-M (7.8 mmID×30 cm) columns by Tosoh Corp. in series, with tetrahydrofuran as the solvent, a temperature of 23° C., a flow rate of 1 mL/min, a sample concentration of 1% by mass, a sample injection rate of 75 μL and a differential refractometer (RI) as the detector.

As examples of preferred non-ash powders to be used in the lubricating oil composition of the invention there may be mentioned polybutenylsuccin imides represented by the following general formula (8) and (9).

[Chemical Formula 8]

(8)

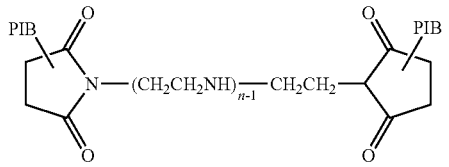

[Chemical Formula 9]

(9)

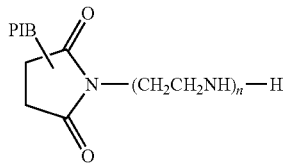

The PIB in general formulas (8) and (9) represent polybutenyl groups, which are obtained from polybutene produced by polymerizing high purity isobutene or a mixture of 1-butene and isobutene with a boron fluoride-based catalyst or aluminum chloride-based catalyst, and the polybutene mixture will usually include 5-100 mol % molecules with vinylidene structures at the ends. From the viewpoint of obtaining a sludge-inhibiting effect, n is an integer of 2-5 and preferably an integer of 3-4.

There are no particular restrictions on the method of producing the succinic acid imide represented by general formula (8) or (9), and for example, polybutenylsuccinic acid obtained by reacting a chlorinated product of the aforementioned polybutene, preferably highly reactive polybutene (polyisobutene) obtained by polymerization of the aforementioned high purity isobutene with a boron fluoride-based catalyst, and more preferably polybutene that has been thoroughly depleted of chlorine or fluorine, with maleic anhydride at 100-200° C., may be reacted with a polyamine such as diethylenetriamine, triethylenetetramine, tetraethylenepentamine or pentaethylenehexamine.

The polybutenylsuccinic acid may be reacted with a twofold (molar ratio) amount of polyamine for production of bis-succinic acid imide, or the polybutenylsuccinic acid may be reacted with an equivalent (equimolar) amount of polyamine for production of a monosuccinic acid imide. From the viewpoint of achieving excellent sludge dispersancy, a bis-polybutenylsuccinic acid imide is preferred.

Since trace amounts of fluorine or chlorine can remain in the polybutene used in the production process described above as a result of the catalyst used in the process, it is preferred to use polybutene that has been thoroughly depleted of fluorine or chlorine by an appropriate method such as adsorption or thorough washing with water. The fluorine or chlorine content is preferably no greater than 50 ppm by mass, more preferably no greater than 10 ppm by mass, even more preferably no greater than 5 ppm by mass and most preferably no greater than 1 ppm by mass.

In processes where polybutene is reacted with maleic anhydride to obtain polybutenylsuccinic anhydride, it has been the common practice to carry out chlorination with chlorine. However, such methods result in significant chlorine residue (for example, approximately 2000-3000 ppm) in the final succinic acid imide product. On the other hand, methods that employ no chlorine, such as methods using highly reactive polybutene and/or thermal reaction processes, can limit residual chlorine in the final product to extremely low levels (for example, 0-30 ppm). In order to reduce the chlorine content in the lubricating oil composition to within a range of 0-30 ppm by mass, therefore, it is preferred to use polybutenylsuccinic anhydride obtained not by a chlorination method but by a method using the aforementioned highly reactive polybutene and/or a thermal reaction process.

As polybutenylsuccinic acid imide derivatives there may be used "modified" succinic acid imides obtained by reacting boron compounds such as boric acid or oxygen-containing organic compounds such as alcohols, aldehydes, ketones, alkylphenols, cyclic carbonates, organic acids and the like with compounds represented by general formula (8) or (9) above, and neutralizing or amidating all or a portion of the residual amino groups and/or imino groups. Particularly advantageous from the viewpoint of heat and oxidation stability are boron-containing alkenyl (or alkyl) succinic acid imides obtained by reaction with boron compounds such as boric acid.

As boron compounds to be reacted with the compound represented by general formula (8) or (9) there may be mentioned boric acids, boric acid salts, boric acid esters and the like.

As specific examples of boric acids there may be mentioned orthoboric acid, metaboric acid and tetraboric acid.

As boric acid salts there may be mentioned alkali metal salts, alkaline earth metal salts and ammonium salts of boric acid, and more specifically, lithium borates such as lithium metaborate, lithium tetraborate, lithium pentaborate and lithium perborate; sodium borates such as sodium metaborate, sodium diborate, sodium tetraborate, sodium pentaborate, sodium hexaborate and sodium octaborate; potassium borates such as potassium metaborate, potassium tetraborate, potassium pentaborate, potassium hexaborate and potassium octaborate; calcium borates such as calcium metaborate, calcium diborate, tricalcium tetraborate, pentacalcium tetraborate and calcium hexaborate; magnesium borates such as magnesium metaborate, magnesium diborate, trimagnesium tetraborate, pentamagnesium tetraborate and magnesium hexaborate; and ammonium borates such as ammonium metaborate, ammonium tetraborate, ammonium pentaborate and ammonium octaborate.

As boric acid esters there may be mentioned esters of boric acid and preferably C1-6 alkyl alcohols, and more specifically there may be mentioned monomethyl borate, dimethyl borate, trimethyl borate, monoethyl borate, diethyl borate, triethyl borate, monopropyl borate, dipropyl borate, tripropyl borate, monobutyl borate, dibutyl borate, tributyl borate and the like.

Succinic acid imide derivatives obtained by reaction with these boron compounds are preferred for superior heat resistance and oxidation stability.

As oxygen-containing organic compounds to be reacted with the compound represented by general formula (8) or (9) there may be mentioned, specifically, C1-30 monocarboxylic acids such as formic acid, acetic acid, glycolic acid, propionic acid, lactic acid, butyric acid, valeric acid, caproic acid, enanthic acid, caprylic acid, pelargonic acid, capric acid, undecylic acid, lauric acid, tridecanoic acid, myristic acid, pentadecanoic acid, palmitic acid, margaric acid, stearic acid, oleic acid, nonadecanoic acid and eicosanoic acid, or C2-30 polycarboxylic acids such as oxalic acid, phthalic acid, trimellitic acid and pyromellitic acid or their anhydrides or esters, and C2-6 alkyleneoxides, hydroxy(poly)oxyalkylene carbonates and the like.

Presumably, reaction of such oxygen-containing organic compounds produces a compound wherein all or a portion of the amino groups or imino groups in the compound represented by general formula (8) or (9) have the structure represented by general formula (10) below.

[Chemical Formula 10]

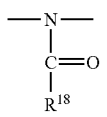

(10)

$R^{18}$ in general formula (10) represents hydrogen, C1-24 alkyl, C1-24 alkenyl, C1-24 alkoxy or a hydroxy(poly)oxyalkylene group represented by —O—$(R^{19}O)_m$H, $R^{19}$ represents C1-4 alkylene and m represents an integer of 1-5. Preferred among these from the viewpoint of excellent sludge dispersancy are polybutenylbissuccinic acid imides, composed mainly of product from reaction of the aforementioned oxygen-containing organic compounds with all of the amino groups or imino groups. Such compounds can be obtained by reacting, for example, 0.5-(n−1) moles and preferably (n−1) moles of oxygen-containing organic compound with 1 mol of the compound of formula (8), for example. Succinic acid imide derivatives obtained by reaction with such oxygen-containing organic compounds have excellent sludge dispersancy, and those reacted with hydroxy(poly)oxyalkylene carbonates are especially preferred.

As a preferred mode wherein a non-ash powder is added to a lubricating oil composition according to the invention, it is preferred to add (D1) a non-ash powder with a weight-average molecular weight of 6500 or greater and/or (D2) a boron-containing non-ash powder with a weight-average molecular weight of 3000 or greater, such compounds of (D1) and (D2) being preferred from the viewpoint of significantly reducing wear in the presence of soot contamination and obtaining a composition with excellent high-temperature detergency. Of these non-ash powders, polybutenylsuccinic acid imides and their derivatives, and especially bis-type compounds, are preferred. The weight-average molecular weight of component (D1) is 6500-20,000, preferably 8000 or greater and even more preferably 9000 or greater, and preferably no greater than 15,000 and most preferably no greater than 12,000. The weight-average molecular weight of component (D2) is 3000-20,000, preferably 4000-6500 and more preferably 4500-5500.

The content of the (D) non-ash powder in the lubricating oil composition of the invention is preferably 0.01-0.4% by mass, more preferably 0.02% by mass or greater and even more preferably 0.04% by mass or greater, and preferably no greater than 0.3% by mass, more preferably no greater than 0.2% by mass and even more preferably no greater than 0.1% by mass, in terms of nitrogen element based on the total amount of the composition. If the content of the (D) non-ash powder is not above the aforementioned lower limit, the anti-wear property in the presence of soot contamination will be insufficient and it may be difficult to exhibit an adequate detergency, while if the content exceeds the aforementioned upper limit the low temperature viscosity property and demulsifying property will tend to be impaired, for which reasons the ranges specified above are particularly preferred.

When using component (D1), the content is preferably 0.005-0.1% by mass and more preferably 0.01-0.04% by mass as nitrogen element based on the total amount of the composition, from the viewpoint of increasing the anti-wear property in the presence of soot contamination and achieving an excellent low temperature viscosity property.

When using component (D2), the content is preferably 0.01% by mass or greater and more preferably 0.02% by mass or greater, and preferably no greater than 0.3% by mass, more preferably no greater than 0.1% by mass and even more preferably no greater than 0.04% by mass as nitrogen element based on the total amount of the composition, in order to satisfactorily increase the high-temperature detergency and thermal stability. For the same reason, the content is preferably 0.001% by mass or greater, more preferably 0.005% by mass or greater and even more preferably 0.008% by mass or greater, and preferably no greater than 0.2% by mass, more preferably no greater than 0.1% by mass, even more preferably no greater than 0.04% by mass and most preferably no greater than 0.02% by mass, as boron element with respect to the total amount of the composition.

The mass ratio of the boron content and nitrogen content (B/N ratio) of component (D2) is preferably 0.1-5, more preferably 0.1-1 and most preferably 0.2-0.6.

The mass ratio of the boron content and nitrogen content (B/N ratio) of the (D) non-ash powder according to the invention is preferably 0.01-5, preferably 0.05-1, more preferably 0.1-0.4 and most preferably 0.1-0.2 in order to reduce wear and friction in the presence of soot contamination and to increase the high-temperature detergency.

The lubricating oil composition of the invention having the construction described above has reduced wear and friction in the presence of soot contamination and excellent high-temperature detergency, and can also improve the cold start-up property and fuel efficiency; however, for even further enhanced performance or for other purposes, any additives commonly used in lubricating oils may also be added. It is particularly preferred to add an organic molybdenum compound as component (E) to the lubricating oil composition of the invention.

As organic molybdenum compounds there may be mentioned (E1) organic molybdenum compounds selected from among molybdenum dithiophosphates and molybdenum dithiocarbamates (molybdenum-based friction modifiers) and (E2) organic molybdenum compounds other than molybdenum dithiophosphates and molybdenum dithiocarbamates. As component (E2) there may be mentioned organic molybdenum compounds other than (E1) that are organic molybdenum compounds containing sulfur as a constituent element and organic molybdenum compounds that do not contain sulfur as a constituent element (molybdenum-based antioxidants), and according to the invention component (E2) is preferably added as an essential component.

As examples of molybdenum dithiophosphates there may be mentioned compounds represented by the following general formula (11).

[Chemical Formula 11]

(11)

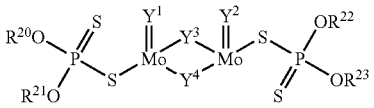

In general formula (11), $R^{20}$, $R^{21}$, $R^{22}$ and $R^{23}$ may be the same or different and each represents a hydrocarbon group, such as a C2-30, preferably C5-18 and more preferably C5-12 alkyl group or a C6-18 and preferably C10-15 (alkyl)aryl group. $Y^1$, $Y^2$, $Y^3$ and $Y^4$ each separately represent a sulfur atom or oxygen atom.

As preferred examples of alkyl groups there may be mentioned ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl, and these may be primary alkyl, secondary alkyl or tertiary alkyl groups and either straight-chain or branched, As preferred examples of (alkyl)aryl groups there may be mentioned phenyl, tolyl, ethylphenyl, propylphenyl, butylphenyl, pentylphenyl, hexylphenyl, octylphenyl, nonylphenyl, decylphenyl, undecylphenyl and dodecylphenyl, and the alkyl groups may be primary alkyl, secondary alkyl or tertiary alkyl groups and either straight-chain or branched. These (alkyl)aryl groups include all substituted isomers with different substitution positions of the alkyl groups on the aryl groups.

Specific preferred examples of molybdenum dithiophosphates include molybdenum sulfide diethyldithiophosphate, molybdenum sulfide dipropyldithiophosphate, molybdenum sulfide dibutyldithiophosphate, molybdenum sulfide dipentyldithiophosphate, molybdenum sulfide dihexyldithiophosphate, molybdenum sulfide dioctyldithiophosphate, molybdenum sulfide didecyldithiophosphate, molybdenum sulfide didodecyldithiophosphate, molybdenum sulfide (butylphenyl)dithiophosphate, molybdenum sulfide (nonylphenyl) dithiophosphate, molybdenum oxysulfide diethyldithiophosphate, molybdenum oxysulfide dipropyldithiophosphate, molybdenum oxysulfide dibutyldithiophosphate, molybdenum oxysulfide dipentyldithiophosphate, molybdenum oxysulfide dihexyldithiophosphate, molybdenum oxysulfide dioctyldithiophosphate, molybdenum oxysulfide didecyldithiophosphate, molybdenum oxysulfide didodecyldithiophosphate, molybdenum oxysulfide (butylphenyl) dithiophosphate, molybdenum oxysulfide (nonylphenyl) dithiophosphate (where the alkyl groups may be straight-chain or branched, and the alkyl groups in the alkylphenyl groups may be bonded at any position), as well as mixtures of the foregoing. Compounds having hydrocarbon groups with different numbers of carbon atoms in each molecule and/or different structures are preferably used as the molybdenum dithiophosphates.

As specific molybdenum dithiocarbamates there may be used compounds represented by the following general formula (12).

[Chemical Formula 12]

(12)

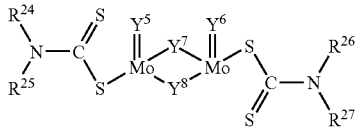

In general formula (12), $R^{24}$, $R^{25}$, $R^{26}$ and $R^{27}$ may be the same or different and each represents a hydrocarbon group, such as a C2-24 or preferably C4-13 alkyl group, or a C6-24 and preferably C10-15 (alkyl)aryl group. $Y^5$, $Y^6$, $Y^7$ and $Y^8$ each separately represent a sulfur atom or oxygen atom.

As preferred examples of alkyl groups there may be mentioned ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl, and these may be primary alkyl, secondary alkyl or tertiary alkyl groups and either straight-chain or branched, As preferred examples of (alkyl)aryl groups there may be mentioned phenyl, tolyl, ethylphenyl, propylphenyl, butylphenyl, pentylphenyl, hexylphenyl, octylphenyl, nonylphenyl, decylphenyl, undecylphenyl and dodecylphenyl, and the alkyl groups may be primary alkyl, secondary alkyl or tertiary alkyl groups and either straight-chain or branched. These (alkyl)aryl groups include all substituted isomers with different substitution positions of the alkyl groups on the aryl groups. As molybdenum dithiocarbamates having structures other than those described above there may be mentioned compounds with structures in which dithiocarbamate groups are coordinated with thio- or polythio-trimeric molybdenum, as disclosed in WO98/26030 and WO99/31113.

Specific preferred examples of molybdenum dithiocarbamates include molybdenum sulfide diethyldithiocarbamate, molybdenum sulfide dipropyldithiocarbamate, molybdenum sulfide dibutyldithiocarbamate, molybdenum sulfide dipentyldithiocarbamate, molybdenum sulfide dihexyldithiocarbamate, molybdenum sulfide dioctyldithiocarbamate, molybdenum sulfide didecyldithiocarbamate, molybdenum sulfide didodecyldithiocarbamate, molybdenum sulfide (butylphenyl)dithiocarbamate, molybdenum sulfide (nonylphenyl)dithiocarbamate, molybdenum oxysulfide diethyldithiocarbamate, molybdenum oxysulfide dipropyldithiocarbamate, molybdenum oxysulfide dibutyldithiocarbamate, molybdenum oxysulfide dipentyldithiocarbamate, molybdenum oxysulfide dihexyldithiocarbamate, molybdenum oxysulfide dioctyldithiocarbamate, molybdenum oxysulfide didecyldithiocarbamate, molybdenum oxysulfide didodecyldithiocarbamate, molybdenum oxysulfide (butylphenyl) dithiocarbamate, molybdenum oxysulfide (nonylphenyl) dithiocarbamate (where the alkyl groups may be straight-chain or branched, and the alkyl groups in the alkylphenyl groups may be bonded at any position), as well as mixtures of the foregoing. Compounds having hydrocarbon groups with different numbers of carbon atoms in each molecule and/or different structures are preferably used as the molybdenum dithiocarbamates.

As organic molybdenum compounds other than molybdenum dithiophosphates and molybdenum dithiocarbamates (E2) there may be mentioned organic molybdenum compounds containing sulfur as a constituent element, other than the compounds of (E1). As organic molybdenum compounds containing sulfur as a constituent element there may be mentioned complexes of molybdenum compounds (for example, molybdenum oxides such as molybdenum dioxide and molybdenum trioxide, molybdic acids such as orthomolybdic acid, paramolybdic acid and (poly)molybdic sulfide, molybdic acid salts such as metal salts or ammonium salts of these molybdic acids, molybdenum sulfides such as molybdenum disulfide, molybdenum trisulfide, molybdenum pentasulfide and polymolybdenum sulfide, molybdic sulfide, molybdic sulfide metal salts or amine salts, molybdenum halides such as molybdenum chloride, and the like), with sulfur-containing organic compounds (for example, alkyl (thio)xanthates, thiadiazoles, mercaptothiadiazoles, thiocarbonates, tetrahydrocarbylthiuramdisulfide, bis(di(thio)hydrocarbyl dithiophosphonate)disulfide, organic (poly)sulfides, sulfurized esters and the like) or other organic compounds, or complexes of sulfur-containing molybdenum compounds such as molybdenum sulfide, molybdic sulfide, or sulfides of molybdenum oxide or sulfides of molybdic acid with organic compounds containing no sulfur, such as the amine compounds, succinic acid imides, organic acids and alcohols described hereunder for organic molybdenum compounds containing no sulfur as a constituent element, or sulfur-containing organic molybdenum compounds obtained by reacting molybdenum compounds containing no sulfur as a constituent element as described hereunder with both the aforementioned organic compounds containing no sulfur and a sulfur source (elemental sulfur, hydrogen sulfide, phosphorus pentasulfide, sulfur oxide, inorganic sulfides, hydrocarbyl (poly) sulfide, olefin sulfides, sulfurized esters, sulfurized waxes, sulfurized carboxylic acids, sulfurized alkylphenols, thioacetamide, thiourea and the like). Production processes for these sulfur-containing organic molybdenum compounds are described in detail in, for example, Japanese Unexamined Patent Publication SHO No. 56-10591 and U.S. Pat. No. 4,263,152.

As organic molybdenum compounds other than molybdenum dithiophosphates and molybdenum dithiocarbamates (E2) there may also be used organic molybdenum compounds containing no sulfur as a constituent element.

As organic molybdenum compounds containing no sulfur as a constituent element there may be mentioned, specifically, molybdenum-amine complexes, molybdenum-succinic acid imide complexes, organic acid molybdenum salts, alcohol molybdenum salts and the like, among which molybdenum-amine complexes, organic acid molybdenum salts and alcohol molybdenum salts are preferred.

As molybdenum compounds in the aforementioned molybdenum-amine complexes there may be mentioned sulfur-free molybdenum compounds such as molybdenum trioxide or its hydrate ($MoO_3.nH_2O$), molybdic acid ($H_2MoO_4$), molybdic acid alkali metal salts ($M_2MOO_4$, where M represents an alkali metal), ammonium molybdenate ($(NH_4)_2MoO_4$ or $(NH_4)_6[Mo_7O_{24}].4H_2O$), $MoCl_5$, $MoOCl_4$, $MoO_2Cl_2$, $MoO_2Br_2$, $Mo_2O_3Cl_6$ and the like. Of these molybdenum compounds, hexavalent molybdenum compounds are preferred from the viewpoint of molybdenum-amine complex yield. From the viewpoint of availability, the preferred hexavalent molybdenum compounds are molybdenum trioxide or its hydrate, molybdic acid, molybdic acid alkali metal salts and ammonium molybdenate.

There are no particular restrictions on amine compounds for the molybdenum-amine complex, but as specific nitrogen compounds there may be mentioned monoamines, diamines, polyamines, alkanolamines and the like. More specific examples include alkylamines with C1-30 alkyl groups (where the alkyl groups may be straight-chain or branched), such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine and propylbutylamine; alkenylamines with C2-30 alkenyl groups (where the alkenyl groups may be straight-chain or branched), such as ethenylamine, propenylamine, butenylamine, octenylamine and oleylamine; alkanolamines with C1-30 alkanol groups (where the alkanol groups may be straight-chain or branched), such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine and propanolbutanolamine; alkylenediamines with C1-30 alkylene groups such as methylenediamine, ethylenediamine, propylenediamine and butylenediamine; polyamines such as diethylenetriamine, triethylenetetramine, tetraethylenepentamine and pentaethylenehexamine; compounds having C8-20 alkyl or alkenyl groups with the aforementioned monoamines, diamines or polyamines, such as undecyldiethylamine, undecyldiethanolamine, dodecyldipropanolamine, oleyldiethanolamine, oleylpropylenediamine and stearyltetraethylenepentamine or heterocyclic compounds such as imidazoline; alkylene oxide addition products of these compounds; and mixtures of the foregoing. Primary amines, secondary amines and alkanolamines are preferred among these amine compounds.

The number of carbon atoms in the hydrocarbon group of the amine compound composing the molybdenum-amine complex is preferably 4 or greater, more preferably 4-30 and most preferably 8-18. If the hydrocarbon group of the amine compound has less than 4 carbon atoms, the solubility will tend to be poor. Limiting the number of carbon atoms in the amine compound to no greater than 30 will allow the molybdenum content in the molybdenum-amine complex to be relatively increased, so that the effect of the invention can be enhanced with a small amount of addition.

As molybdenum-succinic acid imide complexes there may be mentioned complexes of the sulfur-free molybdenum compounds mentioned above for the molybdenum-amine complexes, and succinic acid imides with C4 or greater alkyl or alkenyl groups. As succinic acid imides there may be mentioned succinic acid imides having at least one C40-400 alkyl or alkenyl group in the molecule, as described above for the non-ash powder, or their derivatives, or succinic acid imides with C4-39 and more preferably C8-18 alkyl or alkenyl groups. If the number of carbon atoms of the alkyl or alkenyl group of the succinic acid imide is less than 4, the solubility will tend to be impaired. Although a succinic acid imide with a C30-400 alkyl or alkenyl group may be used, the number of carbon atoms of the alkyl or alkenyl group is preferably no greater than 30 in order to obtain a relatively higher molybdenum content in the molybdenum-succinic acid imide complex, and allow a greater effect according to the invention to be achieved with a smaller amount of addition.

As molybdenum salts of organic acids there may be mentioned salts of organic acids with molybdenum bases such as molybdenum oxides or molybdenum hydroxides, molybdenum carbonate or molybdenum chloride, mentioned above as examples for the molybdenum-amine complexes. Preferred organic acids are sulfur-free phosphorus-containing acids and carboxylic acids, mentioned above for component (B3).

The carboxylic acid in a molybdenum salt of a carboxylic acid may be either a monobasic acid or polybasic acid.

As monobasic acids there may be used C2-30 and preferably C4-24 fatty acids, which may be straight-chain or branched and saturated or unsaturated. As more specific examples there may be mentioned saturated fatty acids such as acetic acid, propionic acid, straight-chain or branched butanoic acid, straight-chain or branched pentanoic acid, straight-chain or branched hexanoic acid, straight-chain or branched heptanoic acid, straight-chain or branched octanoic acid, straight-chain or branched nonanoic acid, straight-chain or branched decanoic acid, straight-chain or branched undecanoic acid, straight-chain or branched dodecanoic acid, straight-chain or branched tridecanoic acid, straight-chain or branched tetradecanoic acid, straight-chain or branched pentadecanoic acid, straight-chain or branched hexadecanoic acid, straight-chain or branched heptadecanoic acid, straight-chain or branched octadecanoic acid, straight-chain or branched hydroxyoctadecanoic acid, straight-chain or branched nonadecanoic acid, straight-chain or branched eicosanoic acid, straight-chain or branched heneicosanoic acid, straight-chain or branched docosanoic acid, straight-chain or branched tricosanoic acid and straight-chain or branched tetracosanoic acid; unsaturated fatty acids such as acrylic acid, straight-chain or branched butenoic acid, straight-chain or branched pentenoic acid, straight-chain or branched hexenoic acid, straight-chain or branched heptenoic acid, straight-chain or branched octenoic acid, straight-chain or branched nonenoic acid, straight-chain or branched decenoic acid, straight-chain or branched undecenoic acid, straight-chain or branched dodecenoic acid, straight-chain or branched tridecenoic acid, straight-chain or branched tetradecenoic acid, straight-chain or branched pentadecenoic acid, straight-chain or branched hexadecenoic acid, straight-chain or branched heptadecenoic acid, straight-chain or branched octadecenoic acid, straight-chain or branched hydroxyoctadecenoic acid, straight-chain or branched nonadecenoic acid, straight-chain or branched eicosenoic acid, straight-chain or branched heneicosenoic acid, straight-chain or branched docosenoic acid, straight-chain or branched tricosenoic acid and straight-chain or branched tetracosenoic acid, as well as mixtures of the above.

The monobasic acid may be a monocyclic or polycyclic carboxylic acid (optionally with hydroxyl groups) in addition to any of the aforementioned fatty acids, and the number of carbon atoms is preferably 4-30 and more preferably 7-30. As examples of monocyclic and polycyclic carboxylic acids there may be mentioned aromatic carboxylic acids and cycloalkylcarboxylic acids with 0-3 and preferably 1-2 C1-30 and preferably C1-20 straight-chain or branched alkyl groups, and more specifically, examples include (alkyl)benzenecarboxylic acids, (alkyl)naphthalenecarboxylic acids and (alkyl)cycloalkylcarboxylic acids. As preferred examples of monocyclic and polycyclic carboxylic acids there may be mentioned benzoic acid, salicylic acid, alkylbenzoic acids, alkylsalicylic acids, cyclohexanecarboxylic acids and the like.

As polybasic acids there may be mentioned dibasic acids, tribasic acids and tetrabasic acids. The polybasic acids may be linear polybasic acids or cyclic polybasic acids. In the case of a linear polybasic acid, it may be straight-chain or branched and either saturated or unsaturated. As linear polybasic acids there are preferred C2-16 linear dibasic acids, and specific examples thereof include ethanedioic acid, propanedioic acid, straight-chain or branched butanedioic acid, straight-chain or branched pentanedioic acid, straight-chain or branched hexanedioic acid, straight-chain or branched heptanedioic acid, straight-chain or branched octanedioic acid, straight-chain or branched nonanedioic acid, straight-chain or branched decanedioic acid, straight-chain or branched undecanedioic acid, straight-chain or branched dodecanedioic acid, straight-chain or branched tridecanedioic acid, straight-chain or branched tetradecanedioic acid, straight-chain or branched heptadecanedioic acid, straight-chain or branched hexadecanedioic acid, straight-chain or branched hexenedioic acid, straight-chain or branched heptenedioic acid, straight-chain or branched octenedioic acid, straight-chain or branched nonenedioic acid, straight-chain or branched decenedioic acid, straight-chain or branched undecenedioic acid, straight-chain or branched dodecenedioic acid, straight-chain or branched tridecenedioic acid, straight-chain or branched tetradecenedioic acid, straight-chain or branched heptadecenedioic acid, straight-chain or branched hexadecenedioic acid, alkenylsuccinic acids and mixtures of the foregoing. As cyclic polybasic acids there may be mentioned alicyclic dicarboxylic acids such as 1,2-cyclohexanedicarboxylic acid and 4-cyclohexene-1,2-dicarboxylic acid, aromatic dicarboxylic acids such as phthalic acid, aromatic tricarboxylic acids such as trimellitic acid and aromatic tetracarboxylic acids such as pyromellitic acid.

As molybdenum salts of alcohols there may be mentioned salts of alcohols with the sulfur-free molybdenum compounds mentioned above for the molybdenum-amine complexes, and the alcohols may be monohydric alcohols, polyhydric alcohols, polyhydric alcohol partial esters or partial ether compounds or hydroxyl group-containing nitrogen compounds (alkanolamines and the like). Molybdic acid is a strong acid and forms esters by reaction with alcohols, and esters of molybdic acid with alcohols are also included within the molybdenum salts of alcohols according to the invention.

As monohydric alcohols there may be used C1-24, preferably C1-12 and more preferably C1-8 monohydric alcohols, and such alcohols may be straight-chain or branched, and either saturated or unsaturated. As specific examples of C1-24 alcohols there may be mentioned methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, straight-chain or branched heptadecanol, straight-chain or branched octadecanol, straight-chain or branched nonadecanol, straight-chain or branched eicosanol, straight-chain or branched heneicosanol, straight-chain or branched tricosanol, straight-chain or branched tetracosanol, and mixtures of the foregoing.

As polyhydric alcohols there may be used C2-10 and preferably C2-6 polyhydric alcohols. As specific examples of C2-10 polyhydric alcohols there may be mentioned dihydric alcohols such as ethylene glycol, diethylene glycol, polyethylene glycol (ethylene glycol 3-15mers), propylene glycol, dipropylene glycol, polypropylene glycol (propylene glycol 3-15mers), 1,3-propanediol, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, 1,5-pentanediol and neopentyl glycol; polyhydric alcohols such as glycerin, polyglycerin (glycerin 2-8mers, such as diglycerin, triglycerin and tetraglycerin), trimethylolalkanes (trimethylolethane, trimethylolpropane, trimethylolbutane and the like) and their 2-8mers, pentaerythritols and their 2-4mers, 1,2,4-butanetriol, 1,3,5-pentanetriol, 1,2,6-hexanetriol, 1,2,3,4-butanetetrol, sorbitol, sorbitan, sorbitolglycerin condensation product, adonitol, arabitol, xylitol and mannitol; saccharides such as xylose, arabinose, ribose, rhamnose, glucose, fructose, galactose, mannose, sorbose, cellobiose, maltose, isomaltose, trehalose and sucrose, and mixtures of the foregoing.

As partial esters of polyhydric alcohols there may be mentioned the polyhydric alcohols mentioned above as polyhydric alcohols having some of the hydroxyl groups hydrocarbylesterified, among which glycerin monooleate, glycerin dioleate, sorbitan monooleate, sorbitan dioleate, pentaerythritol monooleate, polyethyleneglycol monooleate and polyglycerin monooleate are preferred.

As partial ethers of polyhydric alcohols there may be mentioned the polyhydric alcohols mentioned above as polyhydric alcohols having some of the hydroxyl groups hydrocarbylesterified, and compounds having ether bonds formed by condensation between polyhydric alcohols (sorbitan condensation products and the like), among which 3-octadecyloxy-1,2-propanediol, 3-octadecenyloxy-1,2-propanediol, polyethyleneglycol alkyl ethers are preferred.

As hydroxyl group-containing nitrogen compounds there may be mentioned the alkanolamines mentioned above for the molybdenum-amine complexes, as well as alkanolamides obtained by amidation of alkanols with amino groups (diethanolamides and the like), among which stearyldiethanolamine, polyethyleneglycol stearylamine, polyethyleneglycol dioleylamine, hydroxyethyllaurylamine and diethanolamide oleate are preferred.

As the (E) organic molybdenum compound according to the invention there are preferably used one or more sulfur-containing organic molybdenum compounds (E1) selected from among molybdenum dithiophosphate and molybdenum dithiocarbamate, from the viewpoint of an excellent initial friction reducing effect. From the viewpoint of achieving excellent high-temperature detergency, limiting increase in viscosity and more easily maintaining long-term fuel efficiency performance, it is preferred to use an organic molybdenum compound (E2) other than molybdenum dithiophosphate or molybdenum dithiocarbamate. Preferred as component (E2) among those mentioned above are one or more organic molybdenum compounds selected from among complexes or salts of sulfur-containing molybdenum compounds (for example, molybdenum sulfide, oxymolybdenum sulfide or molybdic acid sulfides) with organic compounds containing no sulfur as a constituent element ((amine compounds, succinic acid imides, alcohols, carboxylic acids and the like), complexes or salts of molybdenum compounds containing no sulfur as a constituent element (oxymolybdenum, molybdic acid or the like) with organic compounds containing no sulfur as a constituent element (amine compounds, succinic acid imides, alcohols, carboxylic acids and the like), and organic molybdenum compounds obtained by reacting a sulfur source with a sulfur-containing molybdenum compound or a molybdenum compound containing no sulfur as a constituent element, and an organic compound containing no sulfur as a constituent element.

According to the invention, the use of (E2) is most preferred from the viewpoint of obtaining a composition with excellent high-temperature detergency, and persistence of the initial fuel efficiency performance even in the presence of soot contamination.

The content of the organic molybdenum compound in the composition of the invention is not particularly restricted, but it is preferably 0.001% by mass or greater, more preferably 0.005% by mass or greater and most preferably 0.01% by mass or greater as molybdenum element based on the total amount of the composition. The content is preferably no greater than 0.2% by mass, preferably no greater than 0.1% by mass, more preferably no greater than 0.05% by mass and most preferably no greater than 0.03% by mass. If the content is less than 0.001% by mass the heat and oxidation stability of the lubricating oil composition will be insufficient, and it may not be possible to maintain superior detergency for prolonged periods. On the other hand, if the content is greater than 0.2% by mass the effect will not be commensurate with the increased amount, and the storage stability of the lubricating oil composition will tend to be reduced.

As examples of additives other than the organic molybdenum compound (E) which may be suitably added to the lubricating oil composition of the invention, there may be mentioned additives such as ashless antioxidants, organometallic antioxidants, viscosity index improvers, anti-wear agents other than component (B), corrosion inhibitors, rust-preventive agents, demulsifiers, metal inactivating agents, antifoaming agents and coloring agents.

As ashless antioxidants there may be used any ashless antioxidants commonly employed in lubricating oils, such as phenol-based antioxidants or amine-based antioxidants. Addition of antioxidants can further increase the oxidation resistance of the lubricating oil composition and further improve the oxidation stability, high-temperature detergency and base value retention of the composition of the invention.

As preferred examples of phenol-based antioxidants there may be mentioned 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate], tridecyl-3-(3,5-di-tert-butyl-4-hydroxyphenyl)propionate, pentaerythrityl-tetrakis[3-(3,5-di-tert-butyl-4-hydroxyphenyl)propionate], octyl-3-(3,5-di-tert-butyl-4-hydroxyphenyl)propionate, octadecyl-3-(3,5-di-tert-butyl-4-hydroxyphenyl)propionate, 3-methyl-5-tert-butyl-4-hydroxyphenyl-substituted fatty acid esters and the like. Two or more of these may also be used in admixture.

As examples of amine-based antioxidants there may be mentioned phenyl-α-naphthylamine, alkylphenyl-α-naphthylamine and dialkyldiphenylamine. Two or more of these may also be used in admixture.

As organometallic antioxidants there may be used known organometallic antioxidants that contain metals and are recognized as having antioxidant effects, and component (E2) among the organic molybdenum compounds mentioned above are preferably used.

The aforementioned phenol-based antioxidants, amine-based antioxidants and organometallic antioxidants may also be added in combination.

When an antioxidant is included in the lubricating oil composition of the invention, the content will normally be 0.01-20% by mass, preferably 0.1-10% by mass and more preferably 0.5-5% by mass based on the total amount of the lubricating oil composition. If the content exceeds 20% by mass it will not be possible to achieve sufficient performance commensurate with the added content, while a content of less than 0.01% by mass is not preferred because the effect of improved base value retention will be minimal.

As viscosity index improvers there may be mentioned non-dispersed or dispersed viscosity index improvers. Specifically, there may be mentioned non-dispersant type or dispersant type polymethacrylates, non-dispersant type or dispersant type ethylene-α-olefin copolymers or their hydrides, polyisobutylene or their hydrides, styrene-diene hydrogenation copolymers, styrene-maleic anhydride ester copolymers, methacrylate-styrene copolymers, methacrylate-olefin copolymers and polyalkylstyrene. There are no particular restrictions on the weight-average molecular weight of these viscosity index improvers, but it will generally be 10,000-1,000,000, and from the viewpoint of further increased fuel efficiency and more excellent shear stability, it is preferably 50,000-800,000, more preferably 100,000-600,000 and most preferably 150,000-500,000. There are no particular restrictions on the PSSI of the viscosity index improver, but it is preferably 1-60, more preferably 10-40 and even more preferably 20-30. The PSSI (Permanent Shear Stability Index) referred to here is the index determined by Shear Stability Test (ASTM D6278) using the kinematic viscosity at 100° C. before and after the test and the kinematic viscosity at 100° C. of the base oil, and calculated according to the following formula:

PSSI(%)={1−(kinematic viscosity after shear−kinematic viscosity of base oil)/(kinematic viscosity before shear−kinematic viscosity of base oil)}×100

The content of a viscosity index improver when added will normally be 0.1-20% by mass and is preferably 1-15% by mass and even more preferably 3-10% by mass, based on the total amount of the composition.

As anti-wear agents other than component (B) there may be used, for example, sulfur-based extreme-pressure agents, which can exhibit effects of preventing wear in the presence of soot contamination.

As sulfur-based extreme-pressure agents there may be mentioned sulfur-containing compounds such as disulfides, polysulfides, olefin sulfides, sulfurized fats and oils, sulfurized esters, dithiocarbamates and zinc dithiocarbamate, with sulfurized fats and oils being most preferred. Preferred for use among these compounds are sulfur-based extreme-pressure agents whose sulfur contents are preferably 1-40% by mass, more preferably 5-20% by mass and even more preferably 5-15% by mass. If the sulfur content in the sulfur-based extreme-pressure agent is too high the effect of preventing wear in the presence of soot contamination will not be commensurate with the higher sulfur content, and rather base value retention performance may be impaired, while a low sulfur content in the sulfur-based extreme-pressure agent will result in a minimal effect of preventing wear in the presence of soot contamination. Other publicly known anti-wear agents may be used, including boric acid esters, ashless anti-wear agents, metal anti-wear agents and the like.

When an anti-wear agent other than component (B) is added in the lubricating oil composition of the invention, the content will normally be 0.01-10% by mass and preferably 0.1-5% by mass based on the total amount of the composition.

As examples of corrosion inhibitors there may be mentioned benzotriazole-based, tolyltriazole-based, thiadiazole-based and imidazole-based compounds.

As examples of rust-preventive agents there may be mentioned petroleum sulfonate, alkylbenzenesulfonates, dinonylnaphthalenesulfonate, alkenylsuccinic acid esters and polyhydric alcohol esters.

As examples of demulsifiers there may be mentioned polyalkylene glycol-based nonionic surfactants such as polyoxyethylenealkyl ethers, polyoxyethylenealkylphenyl ethers and polyoxyethylenealkylnaphthyl ethers.

As examples of metal inactivating agents there may be mentioned imidazolines, pyrimidine derivatives, alkylthiadiazoles, mercaptobenzothiazoles, benzotriazole and its derivatives, 1,3,4-thiadiazolepolysulfide, 1,3,4-thiadiazolyl-2,5-bisdialkyldithiocarbamate, 2-(alkyldithio)benzoimidazole and β-(o-carboxybenzylthio)propionitrile.

When the lubricating oil composition of the invention contains a pour point depressant, it is possible to achieve an excellent low temperature viscosity property (a −40° C. MRV viscosity of preferably no greater than 20,000 mPa·s, more preferably no greater than 15,000 mPa·s and even more preferably no greater than 10,000 mPa·s) since the effect of adding the pour point depressant is maximized by the lubricating base oil of the invention. The −40° C. MRV viscosity is the −40° C. MRV viscosity measured according to JPI-5S-42-93. For example, when a pour point depressant is added to the aforementioned base oils (II) and (V), it is possible to obtain a lubricating oil composition having a highly superior low temperature viscosity property with a −40° C. MRV viscosity no greater than 12,000 mPa·s, more preferably no greater than 10,000 mPa·s, even more preferably 8000 mPa·s, most preferably no greater than 6500 mPa·s. In this case, the content of the pour point depressant is 0.05-2% by mass and preferably 0.1-1.5% by mass based on the total amount of the composition, with a range of 0.15-0.8% by mass being optimal for lowering the MRV viscosity, while the weight-average molecular weight of the pour point depressant is preferably 1-300,000 and more preferably 5-200,000, and the pour point depressant is preferably a polymethacrylate-based compound.

As antifoaming agents there may be used any compounds commonly employed as antifoaming agents for lubricating oils, and as examples there may be mentioned silicones such as dimethylsilicone and fluorosilicone. Any one or more selected from these compounds may be added in any desired amount. As examples of antifoaming agents there may be mentioned silicone oils, alkenylsuccinic acid derivatives, esters of long-chain fatty acids and polyhydroxyaliphatic alcohols, methyl salicylate and o-hydroxybenzyl alcohol, aluminum stearate, potassium oleate, N-dialkyl-allylaminenitroaminoalkanols, aromatic amine salts of isoamyloctyl phosphate, alkylalkylene diphosphates, metal derivatives of thioethers, metal derivatives of disulfides, fluorinated aliphatic hydrocarbons, triethylsilane, dichlorosilane, alkylphenylpolyethyleneglycol ether sulfides, fluoroalkyl ethers and the like.

As coloring agents there may be used any normally employed compounds and in any desired amounts, although the contents will usually be 0.001-1.0% by mass based on the total amount of the composition.

When such additives are added to a lubricating oil composition of the invention, the contents will normally be selected in ranges of 0.005-5% by mass for corrosion inhibitors, rust-preventive agents and demulsifiers, 0.005-1% by mass for metal inactivating agents, 0.01-1% by mass for pour point depressants, 0.0001-1% by mass for antifoaming agents and 0.001-1.0% by mass for coloring agents, based on the total amount of the composition.

There are no particular restrictions on the sulfur content in the lubricating oil composition of the invention, but it is preferably no greater than 0.3% by mass, more preferably no greater than 0.26% by mass, even more preferably no greater than 0.2% by mass and most preferably no greater than 0.15% by mass. If the sulfur content exceeds 0.3% by mass, the life of the oxidation catalyst, NOx occlusion-reduction catalyst and DPF in the exhaust gas after-treatment device will tend to be shortened. The sulfated ash content in the lubricating oil composition of the invention is preferably no greater than 1.2% by mass, more preferably no greater than 1.0% by mass and even more preferably no greater than 0.9% by mass from the viewpoint of maintaining the exhaust gas after-treatment device performance, while it is preferably 0.3% by mass or greater and especially 0.7% by mass or greater in order to obtain a composition that can lower the wear and friction in the presence of soot contamination while also exhibiting high-temperature detergency.

The kinematic viscosity at 100° C. of the lubricating oil composition of the invention will normally be 5-30 $mm^2/s$ since this will allow suitable lubricity to be maintained in engines and the like, but from the standpoint of more easily maintaining the anti-wear property in the presence of soot contamination and reduce the friction resistance caused by stirring resistance, it is preferably 8-25 $mm^2/s$, more preferably 9.3-16.3 $mm^2/s$ and most preferably 9.3-11.5 $mm^2/s$.

The viscosity index of the lubricating oil composition of the invention will normally be at least 140 for an improved viscosity-temperature characteristic and fuel efficiency, and it is preferably 150 or greater, more preferably 160 or greater and even more preferably 170 or greater, while from the viewpoint of obtaining excellent shear stability and high-temperature detergency or base value retention it is preferably no greater than 250, more preferably no greater than 200 and even more preferably no greater than 190.

If the lubricating oil composition of the invention has a 150° C. TBS viscosity of preferably 2.6 mPa·s or greater and especially 2.9-3.7 mPa·s it will be possible to further reduce the wear especially in the presence of soot contamination, if it has a −25° C. CCS viscosity of no greater than 3500 mPa·s or a −30° C. CCS viscosity of no greater than 3250 mPa·s it will be possible to obtain an excellent cold-start property even in winter season or cold climates while also achieving improved cold-start fuel efficiency, so that a lubricating oil composition suitable as a 0W-20, 5W-20, 0W-30 or 5W-30 grade engine oil, and especially a 0W-30 grade engine oil, can be obtained.

The lubricating oil composition of the invention has an excellent anti-wear property and superior friction reducing performance, and inhibits the increased wear and increased friction from soot contamination that becomes notable when the content of phosphorus compounds such as ZnDTP is reduced, while also maintaining this performance over long periods, thereby alleviating effects on exhaust gas after-treatment devices. The lubricating oil composition is therefore suitable for diesel engines and direct injection gasoline engines equipped with exhaust gas after-treatment devices employing DPFs or various types of catalysts. It is also useful not only for such engines but also for gasoline engines, diesel engines and gas engines for two-wheel vehicles, four-wheel vehicles, electric power generation and cogeneration, while it can be suitably used not only for such engines that run on fuel with a sulfur content of less than 50 ppm by mass, but also for ships engines, outboard motor engines and the like. It is also suitable as a lubricating oil for internal combustion engines that run on low sulfur fuel, such as fuels with a low sulfur content of 50 ppm by mass or lower, even more preferably 30 ppm by mass or lower and most preferably 10 ppm by mass or lower (for example, gasoline, light oil, kerosene, alcohol, dimethyl ether, LPG, natural gas, hydrogen, GTL (gas-to-liquid fuels) and the like). Since the lubricating oil composition of the invention has excellent oxidation stability, it can also be suitably used as a lubricating oil in a transmission lubricating oil for automatic or manual transmissions, grease, wet oiling brake oil, hydraulic oil, turbine oil, compressor oil, bearing oil, refrigerator oil or the like.

EXAMPLES

The present invention will now be explained in greater detail by examples and comparative examples, with the understanding that these examples are in no way limitative on the invention.

[Production of Base Oil 1]

First, a fraction separated by vacuum distillation in a process for refining of solvent refined base oil was subjected to solvent extraction with furfural and then hydrotreatment, which was followed by solvent dewaxing with a methyl ethyl ketone-toluene mixed solvent. The wax portion removed during solvent dewaxing and obtained as slack wax (hereunder, "WAX1") was used as the stock oil for the lubricating base oil. The properties of WAX1 are shown in Table 1.

TABLE 1

| Name of starting WAX | WAX1 |
|---|---|
| kinematic viscosity at 100° C., $mm^2/s$ | 6.3 |
| Melting point, ° C. | 53 |
| Oil content, % by mass | 19.9 |
| Sulfur content, ppm by mass | 1900 |

Next, WAX1 was used as the stock oil for hydrotreatment with a hydrotreatment catalyst. The reaction temperature and liquid space velocity were controlled for a cracking severity of no greater than 10% by mass for the normal paraffins in the stock oil.

The treatment product obtained from the hydrotreatment was then subjected to hydrodewaxing in a temperature range of 315° C.-325° C. using a zeolite-based hydrodewaxing catalyst adjusted to a precious metal content of 0.1-5% by mass.

The treatment product (raffinate) obtained by this hydrodewaxing was subsequently treated by hydrorefining using a hydrorefining catalyst. The light portion was then separated by distillation to obtain base oil 1 having the composition and properties listed in Table 4. In Table 4, the row headed "Proportion of normal paraffin-derived components in urea adduct" contains the values obtained by gas chromatography of the urea adduct obtained during measurement of the urea adduct value (same hereunder).

A polymethacrylate-based pour point depressant (weight-average molecular weight: approximately 60,000) commonly used in automobile lubricating oils was added to base oil 1 to obtain a lubricating oil composition. The pour point depressant was added in three different amounts of 0.3% by mass, 0.5% by mass and 1.0% by mass based on the total amount of the composition. The −40° C. MRV (Mini Rotary Viscometer) viscosity of each of the obtained lubricating oil compositions was then measured. The results are shown in Table 4

[Production of Base Oil 2]

For production of base oil 2, the wax portion obtained by further deoiling of WAX1 (hereunder, "WAX2") was used as the stock oil for the lubricating base oil. The properties of WAX2 are shown in Table 2.

TABLE 2

| Name of starting WAX | WAX2 |
|---|---|
| kinematic viscosity at 100° C., $mm^2/s$ | 6.8 |
| Melting point, ° C. | 58 |
| Oil content, % by mass | 6.3 |
| Sulfur content, ppm by mass | 900 |

Hydrotreatment, hydrodewaxing, hydrorefining and distillation were carried out in the same manner as for base oil 1, except that WAX2 was used instead of WAX1, to obtain a lubricating base oil having the composition and properties listed in Table 4.

A lubricating oil composition containing a polymethacrylate-based pour point depressant was then prepared in the same manner as with base oil 1, except for using base oil 2, and the −40° C. MRV viscosity was measured. The results are shown in Table 4.

[Production of Base Oil 3]

For base oil 3 there was used an FT wax with a paraffin content of 95% by mass and a carbon number distribution of 20-80 (hereunder, "WAX3"). The properties of WAX3 are shown in Table 3.

TABLE 3

| Name of starting WAX | WAX3 |
|---|---|
| kinematic viscosity at 100° C., $mm^2/s$ | 5.8 |
| Melting point, ° C. | 70 |
| Oil content, % by mass | <1 |
| Sulfur content, ppm by mass | <0.2 |

Hydrotreatment, hydrodewaxing, hydrorefining and distillation were carried out in the same manner as for base oil 1, except that WAX3 was used instead of WAX1, to obtain a lubricating oil base oil 3 having the composition and properties listed in Table 4.

A lubricating oil composition containing a polymethacrylate-based pour point depressant was then prepared in the same manner as with base oil 1, except for using base oil 3, and the −40° C. MRV viscosity was measured. The results are shown in Table 4.

The compositions and properties of base oil 4 and base oil 5 are shown in Table 5, as highly hydrotreated mineral oils not corresponding to the lubricating base oil of the invention.

TABLE 4

| | | Base oil 1 | Base oil 2 | base oil 3 |
|---|---|---|---|---|
| Stock oil | | WAX1 | WAX2 | WAX3 |
| Urea adduct value, % by mass | | 1.18 | 1.22 | 1.15 |
| Proportion of normal paraffin-derived components in urea adduct, % by mass | | 2.4 | 2.5 | 2.3 |
| Base oil composition (based on total base oil) | Saturate, % by mass | 99.7 | 99.6 | 99.8 |
| | Aromatic, % by mass | 0.1 | 0.2 | 0.1 |
| | Polar compounds, % by mass | 0.2 | 0.2 | 0.1 |
| Breakdown of saturate components (based on total saturate components) | Cyclic saturate, % by mass | 12.7 | 12.7 | 8.8 |
| | Acyclic saturate, % by mass | 87.3 | 87.3 | 91.2 |
| Acyclic saturate components in base oil (based on total base oil) | Normal paraffins, % by mass | 0 | 0 | 0 |
| | Isoparaffins, % by mass | 87.0 | 87.0 | 91.0 |
| Breakdown of acyclic saturate components (based on total acyclic saturate content) | Normal paraffins, % by mass | 0 | 0 | 0 |
| | Isoparaffins, % by mass | 100 | 100 | 100 |
| Sulfur content, ppm by mass | | <1 | <1 | <1 |
| Nitrogen content, ppm by mass | | <3 | <3 | <3 |
| Kinematic viscosity (40° C.), $mm^2/s$ | | 15.23 | 15.99 | 16.25 |
| Kinematic viscosity (100° C.), $mm^2/s$ | | 3.770 | 3.880 | 3.900 |
| Viscosity index | | 141 | 141 | 142 |
| Density (15° C.), $g/cm^3$ | | 0.8195 | 0.8197 | 0.8170 |
| Pour point, ° C. | | −22.5 | −22.5 | −22.5 |
| Freezing point, ° C. | | −26 | −26 | −24 |
| Iodine value | | 0 | 0.06 | 0.04 |
| NOACK evaporation (250° C., 1 hour), % by mass | | 12.3 | 12.7 | 14.1 |
| Product of kinematic viscosity (40° C.) and NOACK evaporation | | 187 | 203 | 219 |
| Aniline point, ° C. | | 118.5 | 118.6 | 119.0 |
| Distillation properties ° C. | IBP, ° C. | 363 | 361 | 360 |
| | T10, ° C. | 396 | 399 | 400 |
| | T50, ° C. | 432 | 450 | 436 |
| | T90, ° C. | 459 | 461 | 465 |
| | FBP, ° C. | 489 | 490 | 491 |
| CCS viscosity (−35° C.), mPa · s | | 1450 | 1420 | 1480 |
| Residual metals | Al, ppm by mass | <1 | <1 | <1 |
| | Mo, ppm by mass | <1 | <1 | <1 |
| | Ni, ppm by mass | <1 | <1 | <1 |

TABLE 4-continued

| | | Base oil 1 | Base oil 2 | base oil 3 |
|---|---|---|---|---|
| MRV viscosity (−40° C.), mPa · s | Pour point depressant: 0.3% by mass | 5200 | 5700 | 5900 |
| | Pour point depressant: 0.5% by mass | 5000 | 5450 | 5750 |
| | Pour point depressant: 1.0% by mass | 5500 | 5800 | 6000 |

TABLE 5

| | | Base oil 4 | Base oil 5 |
|---|---|---|---|
| Stock oil | | Vacuum distillation bottom | Vacuum distillation bottom |
| Urea adduct value, % by mass | | 5.2 | — |
| Proportion of normal paraffin-derived components in urea adduct, % by mass | | 1.1 | — |
| Base oil composition (based on total base oil) | Saturate, % by mass | 94.8 | 93.3 |
| | Aromatic, % by mass | 5.2 | 6.6 |
| | Polar compounds, % by mass | 0 | 0.1 |
| Breakdown of saturate components (based on total saturate components) | Cyclic saturate, % by mass | 46.8 | 47.2 |
| | Acyclic saturate, % by mass | 53.2 | 52.8 |
| Acyclic saturate components in base oil (based on total base oil) | Normal paraffins, % by mass | 0.1 | 0.1 |
| | Isoparaffins, % by mass | 50.3 | 49.2 |
| Breakdown of acyclic saturate components (based on total acyclic saturate content) | Normal paraffins, % by mass | 0.2 | 0.2 |
| | Isoparaffins, % by mass | 99.8 | 99.8 |
| Sulfur content, ppm by mass | | 2 | <1 |
| Freezing point, ° C. | | −24 | — |
| Aniline point, ° C. | | 112 | 126 |
| Distillation properties ° C. | IBP, ° C. | 325 | 317 |
| | T10, ° C. | 383 | 412 |
| | T50, ° C. | 420 | 477 |
| | T90, ° C. | 458 | 525 |
| | FBP, ° C. | 495 | 576 |
| CCS viscosity (−35° C.), mPa · s | | 3300 | 13,000 |
| Residual metals | Al, ppm by mass | <1 | <1 |
| | Mo, ppm by mass | <1 | <1 |
| | Ni, ppm by mass | <1 | <1 |

EXAMPLES 1 AND 2

Comparative Examples 1-6

For Examples 1 and 2 and Comparative Examples 1-6, base oil 1 listed in Table 4, base oil 5 listed in Table 5, and base oils 6 and 7 described below and additives were used to prepare lubricating oil compositions having the compositions listed in Tables 6 and 7. The proportions of the base oils in Table 4 and 5 are shown as values based on the total amount of the base oils, and the amounts of additives are shown based on the total amount of the composition.

(Base Oils)

Base oil 6: Poly-α-olefin base oil (kinematic viscosity at 100° C.: 3.9 $mm^2/s$, viscosity index: 126, S: <0.01% by mass, CCS viscosity at −35° C.: 1500 mPa·s, NOACK: 12% by mass)

Base oil 7: Ester base oil (kinematic viscosity at 100° C.: 9.2 $mm^2/s$, viscosity index: 176, pour point: −30° C., S: <0.01% by mass)

(Additives)

A: Oleylurea

B1: Zinc dibutylphosphate (phosphorus content: 13.2% by mass, sulfur content: 0% by mass, zinc content: 13% by mass)

B2: Mixture of sec-butyl-ZnDTP/sec-hexyl-ZnDTP (zinc content: 7.2% by mass, phosphorus content: 6.2% by mass, sulfur content: 14.9% by mass)

C1: Calcium sulfonate (calcium content: 2.4% by mass, sulfur content: 2.9% by mass, metal ratio: 1.0)

C2: Overbased calcium sulfonate (calcium content: 12.7% by mass, sulfur content: 2.0% by mass, metal ratio: 12)

C-3: Calcium salicylate (calcium content: 2.1% by mass, metal ratio: 1.0)

D1: Bis-type polybutenylsuccinimide (nitrogen content: 0.6% by mass, weight-average molecular weight: 10,000)

D2: Boric acid-modified bis-type polybutenylsuccinic acid imide (nitrogen content: 1.5% by mass, B: 0.5% by mass, weight-average molecular weight: 5000)

E1: Molybdenum dithiocarbamate (molybdenum content: 10% by mass, sulfur content: 10% by mass)

E2: Oxymolybdenum-ditridecylamine complex

F: Alkyldiphenylamine

G: Ethylene-α-olefin copolymer-based viscosity index improver (PSSI=24), additive package containing polymethacrylate-based pour point depressant, antifoaming agent, etc.

The performance of the lubricating oil compositions of Examples 1 and 2 and Comparative Examples 1-6 was evaluated by the following methods.

(1) High-Speed Four-Ball Wear Test

As a model of soot-contaminated oil, 1.5% by mass carbon black was dispersed in each lubricating oil composition and a four-ball wear test was carried out under the following test conditions according to JPI-5S-32-90, with measurement of the wear scar diameter after the test. The results are shown in Tables 6 and 7. In this test, a smaller wear scar diameter indicates more excellent wear resistance.

(Test Conditions)

Rotation speed: 1500 rpm

Load: 294 N

Test oil temperature: 110° C.

Test time: 1 hour (2) HFRR friction test

Two different test oils were prepared for each lubricating oil composition, one with dispersion of 1.5% by mass carbon black and one without dispersion of carbon black, and a HFRR friction tester was used for measurement of the frictional coefficient under the following conditions. The results are shown in Tables 6 and 7. In this test, a smaller frictional coefficient indicates more excellent fuel efficiency, and a smaller frictional coefficient after addition of carbon black indicates a superior friction reducing effect and better retention thereof in the presence of soot contamination.

(Test Conditions)

Dead weight: 200 g

Test oil temperature: 10° C.

Stroke: 1 mm

Frequency: 50 Hz

Test time: 1 hour

Frictional coefficient measurement: The frictional coefficients up to 50 minutes-60 minutes after start of the test were averaged.

TABLE 6

| | | Example 1 | Example 2 | Comp. Ex. 1 | Comp. Ex. 2 |
|---|---|---|---|---|---|
| Compositions of lubricating base oils | Base oil 1 (% by mass) | 65 | 90 | — | — |
| | Base oil 4 (% by mass) | — | — | — | — |
| | Base oil 5 (% by mass) | 35 | — | 35 | 35 |
| | Base oil 6 (% by mass) | — | — | 65 | 65 |
| | Base oil 7 (% by mass) | — | 10 | — | — |
| Total lubricating oil composition | Lubricating base oil (% by mass) | Remainder | Remainder | Remainder | Remainder |
| | Ashless friction modifier A (% by mass) | 0.3 | 0.3 | 0.3 | 0.3 |
| | Phosphorus-containing anti-wear agent B1 (P content, % by mass) | 0.05 | 0.05 | 0.05 | 0.05 |
| | Phosphorus-containing anti-wear agent B2 (P content, % by mass) | — | — | — | — |
| | Metallic detergent C1 (metal content, % by mass) | 0.024 | 0.024 | 0.024 | — |
| | Metallic detergent C2 (metal content, % by mass) | 0.21 | 0.21 | 0.21 | 0.21 |
| | Metallic detergent C3 (metal content, % by mass) | — | — | — | 0.03 |
| | Dispersant D1 (N content, % by mass) | 0.03 | 0.03 | 0.03 | 0.03 |
| | Dispersant D2 (N content, % by mass) | 0.03 | 0.03 | 0.03 | 0.03 |
| | Organic Mo compound E1 (Mo content, % by mass) | — | — | — | — |
| | Organic Mo compound E2 (Mo content, % by mass) | 0.02 | 0.02 | 0.02 | 0.02 |
| | Ashless antioxidant F (% by mass) | 0.8 | 0.8 | 0.8 | 0.8 |
| | Additive package G (% by mass) | 8 | 8 | 8 | 8 |
| High-speed four-ball wear (1.5% CB, mm) | | 0.29 | 0.28 | 0.48 | 0.48 |
| HFRR friction coefficient | New oil | 0.066 | 0.063 | 0.065 | 0.067 |
| | CB 1.5% | 0.055 | 0.062 | 0.070 | 0.068 |

TABLE 7

| | | Comp. Ex. 3 | Comp. Ex. 4 | Comp. Ex. 5 | Comp. Ex. 6 |
|---|---|---|---|---|---|
| Compositions of lubricating base oils | Base oil 1 (% by mass) | — | — | — | — |
| | Base oil 4 (% by mass) | 65 | — | — | — |
| | Base oil 5 (% by mass) | 35 | 35 | 35 | 35 |
| | Base oil 6 (% by mass) | 65 | 65 | 65 | 65 |
| | Base oil 7 (% by mass) | — | — | — | — |
| Total lubricating oil composition | Lubricating base oil (% by mass) | Remainder | Remainder | Remainder | Remainder |
| | Ashless friction modifier A (% by mass) | 0.3 | — | 0.3 | 0.3 |
| | Phosphorus-containing anti-wear agent B1 (P content, % by mass) | 0.05 | 0.05 | — | — |
| | Phosphorus-containing anti-wear agent B2 (P content, % by mass) | — | — | 0.05 | — |
| | Metallic detergent C1 (metal content, % by mass) | — | — | 0.024 | 0.024 |
| | Metallic detergent C2 (metal content, % by mass) | 0.21 | 0.21 | 0.21 | 0.21 |
| | Metallic detergent C3 (metal content, % by mass) | 0.03 | 0.03 | — | — |
| | Dispersant D1 (N content, % by mass) | 0.03 | 0.03 | 0.03 | 0.03 |
| | Dispersant D2 (N content, % by mass) | 0.03 | 0.03 | 0.03 | 0.03 |
| | Organic Mo compound E1 (Mo content, % by mass) | — | 0.05 | — | 0.05 |
| | Organic Mo compound E2 (Mo content, % by mass) | 0.02 | — | 0.02 | — |
| | Ashless antioxidant F (% by mass) | 0.8 | 0.8 | 0.8 | 0.8 |
| | Additive package G (% by mass) | 8 | 8 | 8 | 8 |
| High-speed four-ball wear (1.5% CB, μm) | | 0.55 | 0.57 | 0.47 | 0.63 |
| HFRR friction coefficient | New oil | 0.067 | 0.068 | 0.069 | — |
| | CB 1.5% | 0.090 | 0.099 | 0.072 | — |

As clearly seen by the results in Tables 6 and 7, the lubricating oil compositions of Examples 1 and 2 exhibited notably superior anti-wear performance in the presence of soot contamination, while virtually no increase was observed in the frictional coefficients with soot contamination as compared to the frictional coefficients without soot contamination. These results demonstrate that marked improvement is achieved even in comparison to using a PAO base oil or conventional hydrotreated mineral oil instead of base oil 1 (Comparative Examples 1-6).

What is claimed is:

1. A lubricating oil composition comprising a lubricating base oil with a urea adduct value of no greater than 4% by mass, a NOACK evaporation of no greater than 15% by mass and a viscosity index of 100 or higher, an ashless friction modifier at 0.01-10% by mass and a phosphorus-containing anti-wear agent at 0.01-0.2% by mass as phosphorus, based on the total amount of the composition.

2. A lubricating oil composition according to claim 1, wherein the lubricating base oil is produced by a production process that includes a step of hydrotreatment/hydroisomerization of a stock oil containing normal paraffins so as to obtain a treatment product having a urea adduct value of no greater than 4% by mass and a viscosity index of 100 or higher.

3. A lubricating oil composition according to claim 1, wherein the lubricating base oil has a kinematic viscosity at 100° C. of 3.5 $mm^2/s$ or greater and a CCS viscosity at −35° C. of no greater than 2000 mPa·s.

4. A lubricating oil composition according to claim 1, wherein the product of the kinematic viscosity at 40° C. (units: $mm^2/s$) and the NOACK evaporation (units: % by mass) of the lubricating base oil is no greater than 250.

5. A lubricating oil composition according to claim 1, wherein the ashless friction modifier is a compound containing at least 3 atoms of any one or more selected from among nitrogen, oxygen and sulfur.

6. A lubricating oil composition according to claim 1, which contains an organic molybdenum compound other than molybdenum dithiocarbamate or molybdenum dithiophosphate at 0.001-0.2% by mass as molybdenum based on the total amount of the composition.

* * * * *